US010278529B2

(12) United States Patent
Baines

(10) Patent No.: US 10,278,529 B2
(45) Date of Patent: May 7, 2019

(54) ROOM DARKENING CURTAIN RODS INCLUDING REMOVABLE FINIALS

(71) Applicant: Maytex Mills, Inc., New York, NY (US)

(72) Inventor: David M. Baines, Bedford, NY (US)

(73) Assignee: Maytex Mills, Inc., New York, NY (US)

( * ) Notice: Subject to any disclaimer, the term of this patent is extended or adjusted under 35 U.S.C. 154(b) by 0 days.

(21) Appl. No.: 15/839,308

(22) Filed: Dec. 12, 2017

(65) Prior Publication Data

US 2018/0098656 A1 Apr. 12, 2018

Related U.S. Application Data

(63) Continuation-in-part of application No. 15/266,841, filed on Sep. 15, 2016, now Pat. No. 10,092,126.
(Continued)

(51) Int. Cl.
*A47H 1/00* (2006.01)
*A47H 1/02* (2006.01)
(Continued)

(52) U.S. Cl.
CPC ..... *A47H 1/022* (2013.01); *A47H 1/102* (2013.01); *A47H 1/12* (2013.01); *A47H 1/122* (2013.01);
(Continued)

(58) Field of Classification Search
CPC .... A47G 2200/10; A47H 1/022; A47H 1/122; A47H 1/142; A47H 2001/0215; A47H 1/08; A47H 1/02; A47H 1/10; A47H 1/102; A47H 1/104; A47H 1/12; A47H 1/124; A47H 1/13; A47H 1/14; A47H 1/144; A47H 2001/003; A47H 1/00; A47H 2001/006; A47K 3/38; Y10S 211/01
(Continued)

(56) References Cited

U.S. PATENT DOCUMENTS 562,380 A 6/1896 Durphy et al.
852,941 A 5/1907 Fenian
(Continued)

FOREIGN PATENT DOCUMENTS

DE 29715963 U1 10/1997
DE 202005015116 U1 2/2006

*Primary Examiner* — Jennifer E. Novosad
(74) *Attorney, Agent, or Firm* — Christopher J. Owens; Leech Tishman Fuscaldo & Lampl

(57) ABSTRACT

Room darkening window curtain rod assemblies that include a curtain rod and two bracket assemblies, each including a removable magnetic finial are disclosed. Each bracket assembly includes a wraparound leg that extends perpendicularly from an axis of the curtain rod toward a wall or window frame upon which the assembly is installed. The removable finials allow a curtain to be drawn onto the wraparound leg of each bracket assembly from the curtain rod to provide curtain wraparound regions. The curtain wraparound regions reduce or prevent light from entering into a room, and allow the bracket assemblies to be hidden. Once the curtain is extended into the wraparound regions, the magnetic finials are magnetically attached to the bracket assemblies with portions of the curtain located therebetween.

17 Claims, 12 Drawing Sheets

Related U.S. Application Data

(60) Provisional application No. 62/433,057, filed on Dec. 12, 2016, provisional application No. 62/220,021, filed on Sep. 17, 2015.

(51) Int. Cl.

| | |
|---|---|
| ***A47H 1/12*** | (2006.01) |
| ***A47H 1/13*** | (2006.01) |
| ***A47H 1/14*** | (2006.01) |
| ***A47H 1/022*** | (2006.01) |
| ***A47H 1/102*** | (2006.01) |
| ***A47H 1/122*** | (2006.01) |
| ***A47H 1/142*** | (2006.01) |

(52) U.S. Cl.
CPC ..... *A47H 1/13* (2013.01); *A47H 1/14* (2013.01); *A47H 1/142* (2013.01); *A47H 2001/006* (2013.01); *A47H 2001/0215* (2013.01); *Y10S 211/01* (2013.01)

(58) Field of Classification Search
USPC ..... 211/105.1–105.6, 123, DIG. 1; 248/251, 248/257, 227.4, 254, 258, 259, 262, 261, 248/265, 267, 683, 206.5, 309.4, 350
See application file for complete search history.

(56) References Cited

U.S. PATENT DOCUMENTS

| | | | | |
|---|---|---|---|---|
| 978,114 | A | 12/1910 | Cook | |
| 1,341,562 | A | 5/1920 | Kasbohm | |
| 1,537,242 | A * | 5/1925 | Lukins | F24D 19/00 126/332 |
| 2,433,527 | A | 12/1947 | Mohr et al. | |
| 2,459,619 | A | 1/1949 | Chatterton | |
| 2,551,432 | A | 5/1951 | Goodman | |
| 2,560,942 | A | 7/1951 | Ford et al. | |
| 2,653,718 | A | 9/1953 | Woodward | |
| 2,689,103 | A | 9/1954 | Ackerman | |
| 2,739,644 | A | 3/1956 | Brand | |
| 2,937,838 | A | 5/1960 | Kelvington | |
| 2,998,955 | A | 9/1961 | Hertzog | |
| 3,095,033 | A | 6/1963 | Polkosnik | |
| 3,104,086 | A | 9/1963 | Salzmann | |
| 3,504,805 | A | 4/1970 | Doyle | |
| 4,140,294 | A * | 2/1979 | Zwarts | A47H 1/122 248/265 |
| 4,322,050 | A | 3/1982 | Roach | |
| 4,915,343 | A | 4/1990 | Terlecke | |
| 5,082,226 | A | 1/1992 | Mahan | |
| 5,549,407 | A | 8/1996 | Levi et al. | |
| 5,678,703 | A | 10/1997 | Sawyer | |
| 5,702,010 | A | 12/1997 | Liang | |
| 6,233,877 | B1 | 5/2001 | Monroe | |
| 7,264,515 | B1 * | 9/2007 | Rubinstein | H01R 13/746 211/85.2 |
| 7,322,552 | B1 | 1/2008 | Lin | |
| 7,641,060 | B2 * | 1/2010 | Bishop | A47H 1/02 211/105.1 |
| 8,469,207 | B2 | 6/2013 | Rowan et al. | |
| 8,479,931 | B1 | 7/2013 | Richards et al. | |
| 8,783,476 | B2 * | 7/2014 | Woodley | A47F 5/105 211/183 |
| 8,814,114 | B2 | 8/2014 | Baines | |
| 8,851,305 | B2 | 10/2014 | Didehvar | |
| 8,960,456 | B2 | 2/2015 | Didehvar | |
| 9,700,170 | B1 * | 7/2017 | Kouts | A47H 15/02 |
| 10,092,126 | B2 * | 10/2018 | Baines | A47H 1/022 |
| 2002/0088909 | A1 * | 7/2002 | Chen | A47G 25/0692 248/251 |
| 2003/0052244 | A1 | 3/2003 | Goldstein | |
| 2005/0199567 | A1 * | 9/2005 | Tardiff | B66C 1/10 211/105.3 |
| 2006/0060314 | A1 * | 3/2006 | Battista | A47H 1/022 160/330 |
| 2007/0090246 | A1 | 4/2007 | Carvalho et al. | |
| 2008/0120865 | A1 * | 5/2008 | Smith | F26B 25/18 34/239 |
| 2008/0135422 | A1 * | 6/2008 | Martinez | A47F 7/02 206/6.1 |
| 2009/0173457 | A1 | 7/2009 | Navarro et al. | |
| 2012/0005823 | A1 | 1/2012 | Baines | |
| 2013/0112639 | A1 | 5/2013 | Baines | |
| 2013/0341474 | A1 | 12/2013 | Baines | |
| 2014/0166215 | A1 * | 6/2014 | Thomas | A47H 2/00 160/38 |
| 2014/0166603 | A1 | 6/2014 | Baines | |
| 2015/0114578 | A1 * | 4/2015 | Baines | A47H 13/00 160/330 |
| 2015/0114579 | A1 * | 4/2015 | Baines | A47H 13/02 160/330 |
| 2016/0242586 | A1 | 8/2016 | Mateer | |
| 2016/0374498 | A1 * | 12/2016 | Olivo | A47H 19/00 160/349.2 |
| 2017/0079457 | A1 | 3/2017 | Baines | |
| 2017/0153020 | A1 * | 6/2017 | Lee | F21V 33/0056 |
| 2017/0188739 | A1 * | 7/2017 | Kouts | A47H 15/02 |
| 2018/0098656 | A1 * | 4/2018 | Baines | A47H 1/122 |

* cited by examiner

ROOM DARKENING CURTAIN RODS INCLUDING REMOVABLE FINIALS

CROSS-REFERENCE TO RELATED APPLICATION

This application is a continuation-in-part of U.S. patent application Ser. No. 15/266,841 filed on Sep. 15, 2016, which claims the benefit of U.S. Provisional Patent Application Ser. No. 62/220,021 filed on Sep. 17, 2015. This application claims the benefit of U.S. Provisional Patent Application Ser. No. 62/433,057 filed on Dec. 12, 2016. All of these prior applications are incorporated herein by reference.

FIELD OF THE INVENTION

This invention relates to window curtain rods, and more particularly relates to room darkening window curtain rod assemblies including removable finials which permit window curtains to be taken completely to a wall.

BACKGROUND INFORMATION

Conventional window curtain rods with finials require window curtain to remain on only the curtain rod itself. In order for window curtains to extend beyond the outer vertical edges of windows and to a wall for light blocking and aesthetics, finials are not used on conventional window curtain rods because they impede the ability of curtains to extend to the wall. This necessitates a decision as to utility or appearance. Alternatively, a user can make sewing adjustments to the curtains themselves to enable them to be taken completely to the wall. This requires an ability to make the sewing adjustments, where mistakes in measuring are common, frequently resulting in misplaced holes in expensive curtains.

Accordingly, a need exists for room darkening window curtain rod assemblies that allow curtains to extend beyond the outer vertical edges of window that can also include a decorative finial.

SUMMARY OF THE INVENTION

Window curtain rod assemblies are provided that include a rod and brackets, each including a removable finial. The removable finial allows a curtain to be drawn onto the brackets from the curtain rod to provide curtain wraparound regions that reduce or prevent light from entering into the room.

An aspect of the present invention is to provide a curtain rod comprising a first end and a second end, a first bracket assembly structured and arranged to receive the first end of the curtain rod comprising a first wraparound leg extending perpendicularly away from a longitudinal axis of the curtain rod, and a first removable magnetic finial, and a second bracket assembly structured and arranged to receive the second end of the curtain rod comprising a second wraparound leg extending perpendicularly away from the longitudinal axis of the curtain rod, and a second removable magnetic finial.

Another aspect of the present invention is to provide a bracket assembly for a window curtain rod comprising a bracket including a first substantially cylindrical end defining an axial direction structured and arranged to receive an end of a curtain rod, and a wraparound leg laterally offset from the first substantially cylindrical end in a direction substantially perpendicular to the axial direction of the first substantially cylindrical end, and a magnetic finial removably magnetically attached to the bracket.

A further aspect of the present invention is to provide a window curtain and rod assembly comprising a curtain rod comprising a first end and a second end, a first bracket assembly structured and arranged to receive the first end of the curtain rod comprising a first wraparound leg extending perpendicularly away from a longitudinal axis of the curtain rod, a second bracket assembly structured and arranged to receive the second end of the curtain rod comprising a second wraparound leg extending perpendicularly away from the longitudinal axis of the curtain rod, a curtain mounted on the curtain rod, wherein the curtain is drawn onto the first and second wraparound legs to thereby provide first and second curtain wraparound regions, a first magnetic finial magnetically attached to the first bracket assembly with a portion of the curtain therebetween, and a second magnetically finial magnetically attached to the second bracket assembly with another portion of the curtain therebetween.

These and other aspects of the present invention will be more apparent from the following description.

DETAILED DESCRIPTION

Window curtain rod assemblies are provided that include a rod and brackets, each including a removable magnetic finial. The removable finials allow a curtain to be drawn onto wraparound legs of the brackets from the curtain rod to provide curtain wraparound regions that reduce or prevent light from entering into a room. The curtain wraparound regions allow the curtain to be drawn to the wall and hide the brackets from view.

In certain embodiments, the window curtain rod assemblies may include alignment brackets that are easy to install. The alignment brackets may be attached to a wall against the vertical edge of a window frame while also allowing the curtain to extend horizontally beyond the vertical edges of the window frame. In certain embodiments, the alignment bracket assemblies may be mounted on a window stud adjacent to the window frame. In accordance with typical window construction techniques, window studs are positioned adjacent to the vertical portions of a window frame, while areas away from the window frame may not have studs at such locations, e.g., such locations may only comprise drywall or plaster with no underlying studs. Mounting the alignment bracket assemblies on window studs provides the window curtain rod assembly additional stability to accommodate a variety of window curtains. The rod and curtain are allowed to extend beyond the vertical edges of the window due to a portion of the alignment bracket assembly that extends in a horizontal curtain extension distance parallel with an axial direction of the telescoping curtain rod. If the user chooses to position the rod at a higher level, this can be done by aligning the bracket at the desired height along the vertical window edge. The installation process for these window curtain rod assemblies may take only a few minutes.

Figure 1:
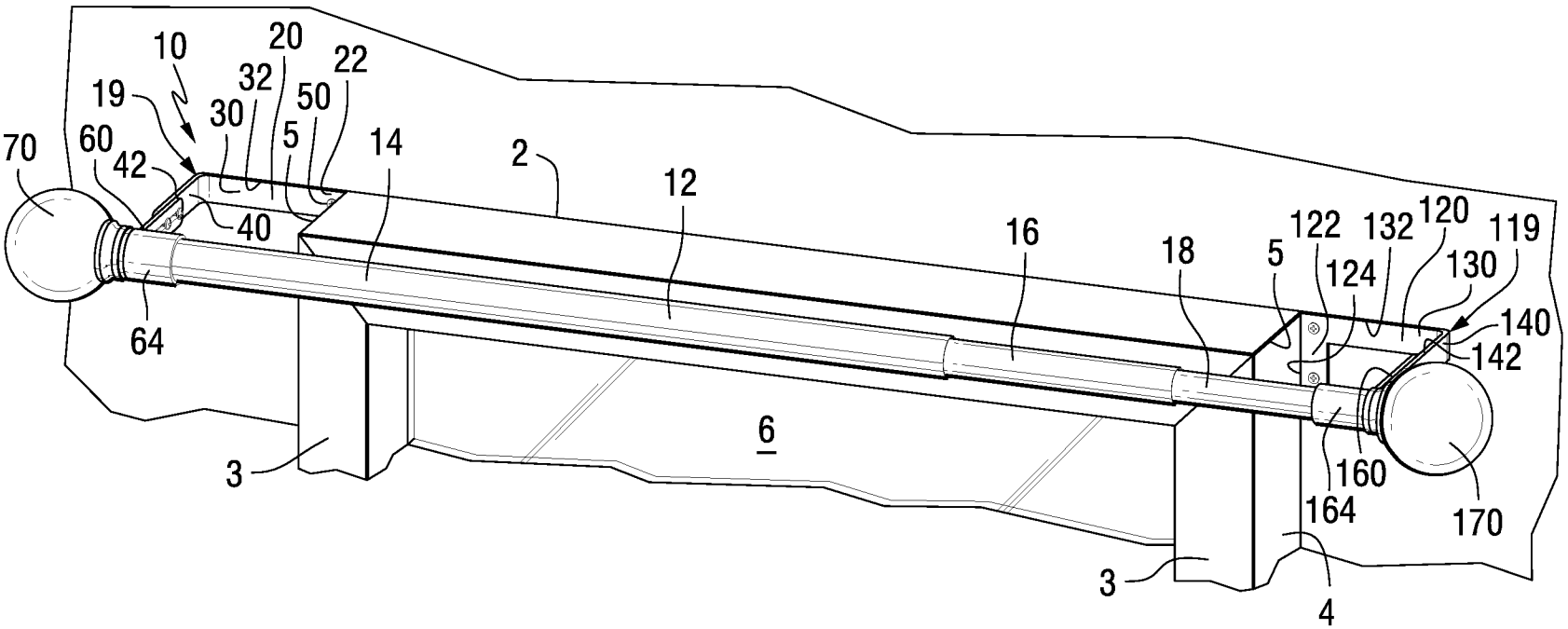
FIG. 1 is an isometric view of a window curtain rod assembly illustrating the window curtain rod assembly mounted around a window frame.
Figure 2:
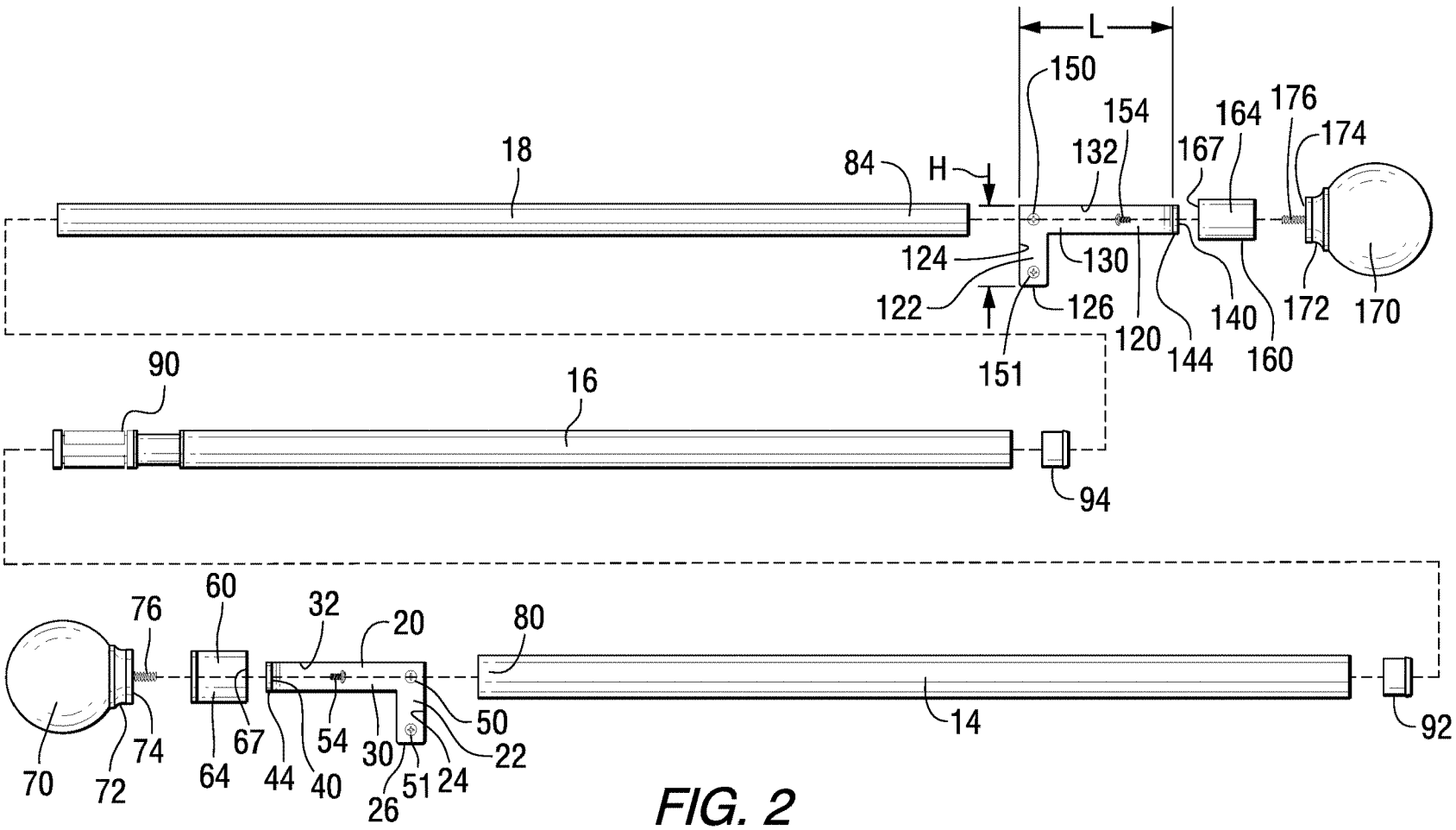
FIG. 2 is a front exploded view of the window curtain rod assembly of FIG. 1
Figure 3:
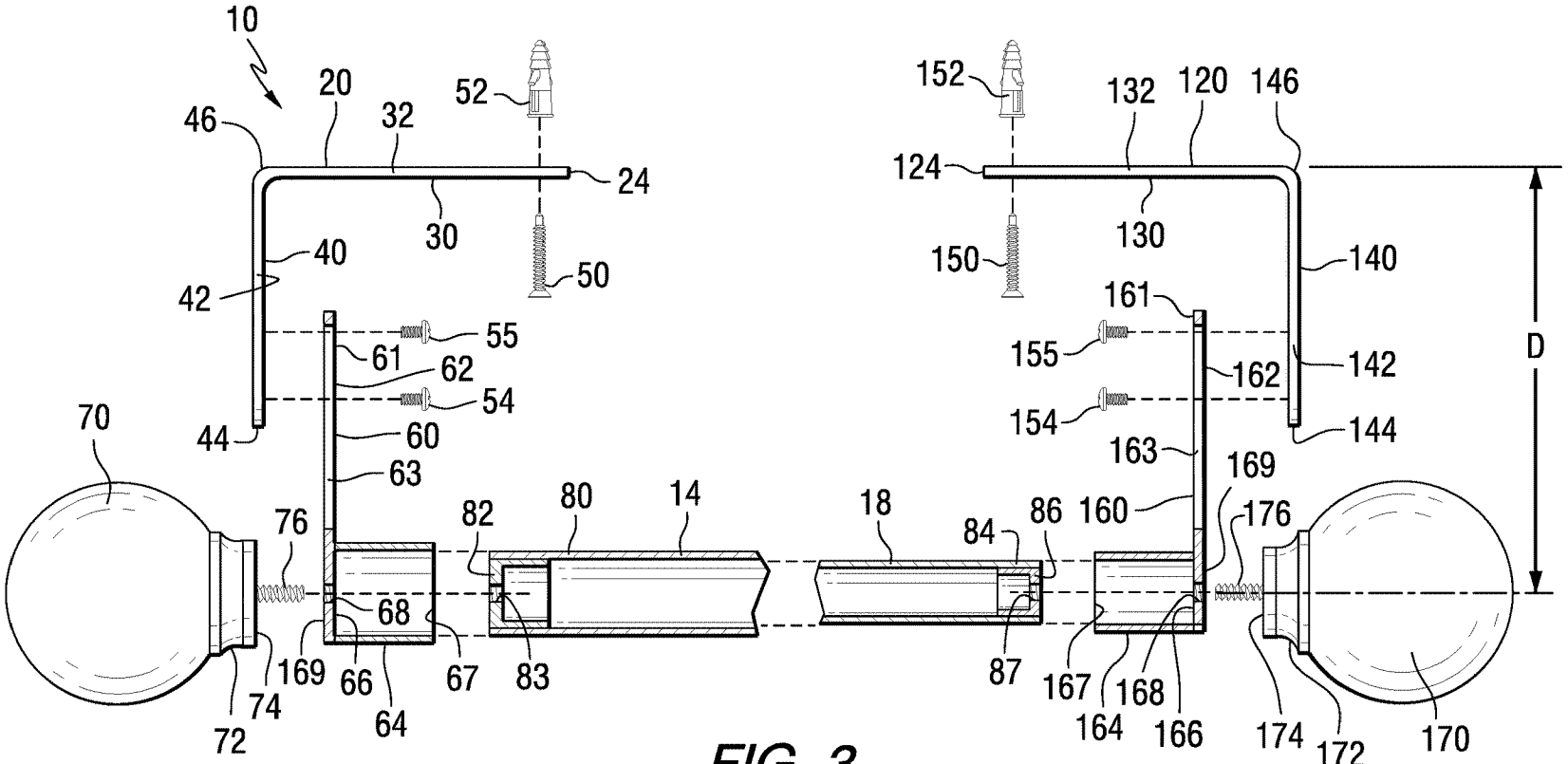
FIG. 3 is a top exploded view of the bracket assemblies of the window curtain rod assembly of FIG. 1.

FIG. 1 illustrates a window curtain rod assembly 10 mounted over a window frame 2. In accordance with an embodiment of the present invention, the window curtain rod assembly may include removable finials, as more fully described below and illustrated in FIGS. 20-28. As shown in FIG. 1, the window frame 2 includes a front wall 3, exterior window frame sidewalls 4 and top edge 5. As used herein, the terms "window frame", "front wall", "exterior window frame sidewalls" and "top edge" may refer to casement windows including additional material surrounding the opening in the wall, or windows only including an opening in the wall. As used herein, "exterior window frame sidewall" means a vertical portion of a window frame. The window curtain rod assembly 10 includes a telescoping curtain rod 12, a first alignment bracket assembly 19 and a second alignment bracket assembly 119. As shown in FIGS. 1-3, the telescoping curtain rod 12 comprises a first telescoping rod section 14 (also called a first end rod section), a second telescoping rod section 16 (also called an intermediate section) and a third telescoping rod section 18 (also called a second end rod section). The first, second and third rod sections are configured in a telescoping arrangement such that a portion of the third rod section 18 is configured to slide into a portion of the second rod section 16, and a portion of the second rod section 16 is configured to slide into a portion of the first rod section 14. The telescoping curtain rod 12 defines an axial direction. In the embodiment shown, the telescoping curtain rod 12 includes first, second and third rod sections. However, any other suitable number of rod sections may be used, e.g., one, two, four or more rod sections. For example, a first end rod section and a second end rod section may be axially moveable and/or lockable with respect to each other.

Figure 4:
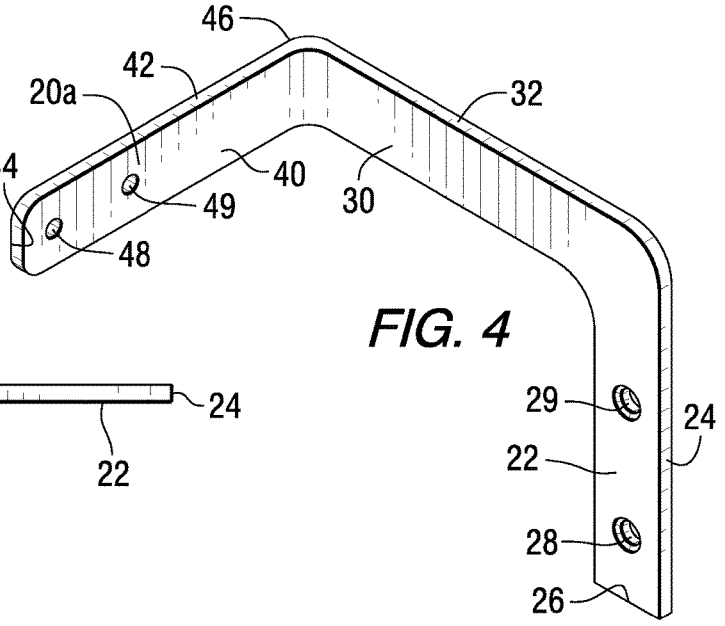
FIG. 4 is an isometric view of an alignment mounting bracket.
Figure 7:
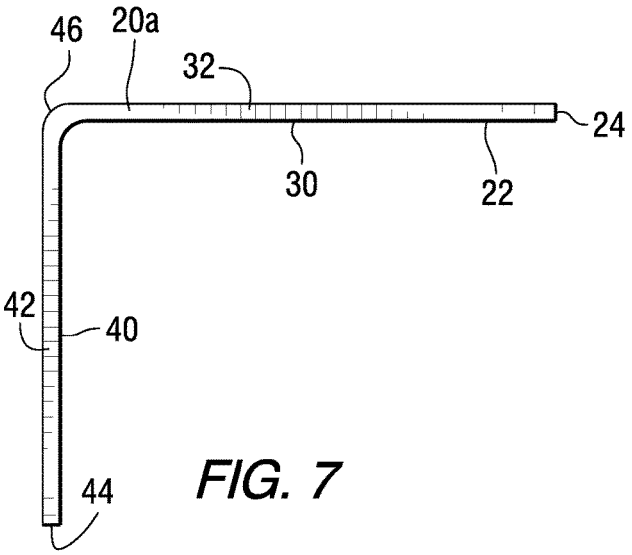
FIG. 7 is a top view of the alignment mounting bracket of FIG. 4.
Figure 5:
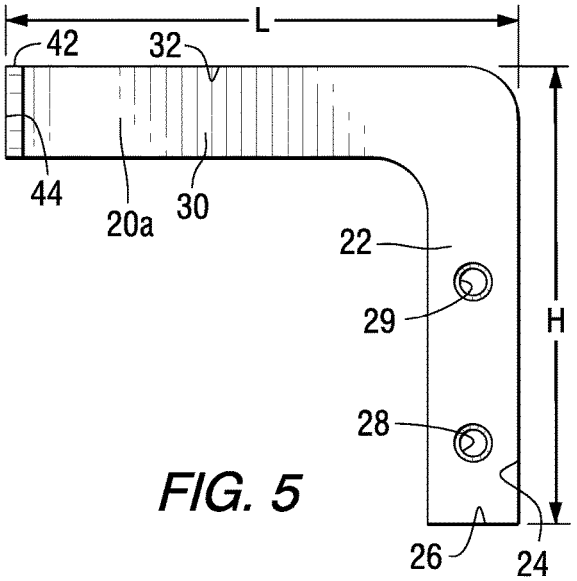
FIG. 5 is a front view of the alignment mounting bracket of FIG. 4.
Figure 6:
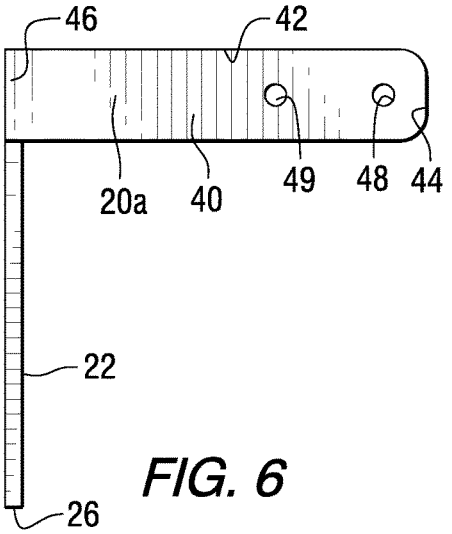
FIG. 6 is a side view of the alignment mounting bracket of FIG. 4.
Figure 8:
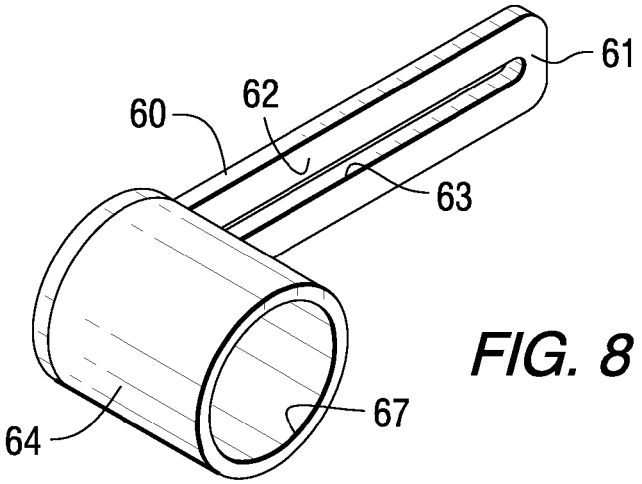
FIG. 8 is an isometric view of a support arm.
Figure 11:
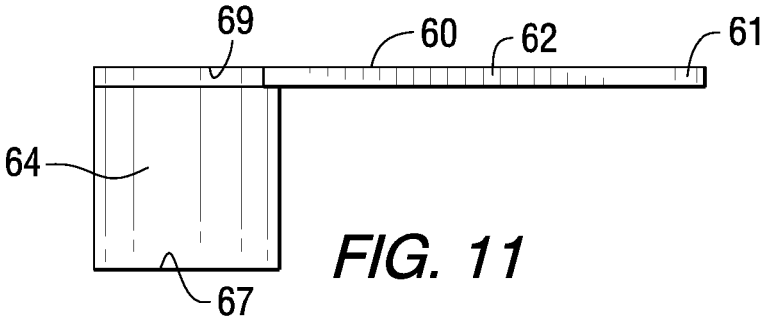
FIG. 11 is a top view of the support arm of FIG. 8.
Figure 9:
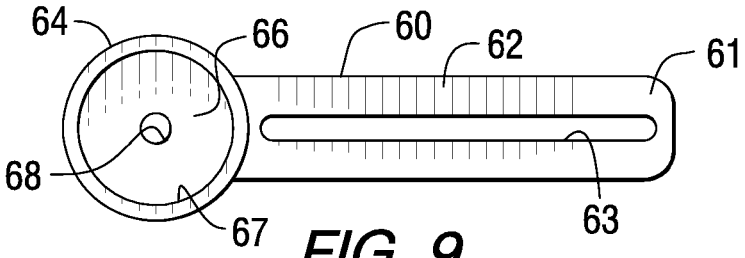
FIG. 9 is a front view of the support arm of FIG. 8.

As shown in FIGS. 1-3, the first alignment bracket assembly 19 includes an alignment mounting bracket 20 and a support arm 60. The alignment mounting bracket 20 includes a vertical guide leg 22, a first horizontal leg 30 and a second horizontal leg 40. The vertical guide leg 22 includes a vertical guide edge 24, a lower end 26 and an upper end terminating at a horizontal guide edge 32. As used herein, the term "vertical guide edge" means a substantially straight edge in a substantially vertical direction that is used to align the edge with a vertical portion of a window frame. As shown in FIG. 4, the vertical guide leg 22 may also include alignment mounting bracket wall mounting holes 28 and 29. The first horizontal leg 30 may extend from the vertical guide leg 22 in a direction substantially parallel with the axial direction of the telescoping curtain rod 12, and includes a horizontal guide edge 32 and a window frame end terminating in the vertical guide edge 24. The first horizontal leg 30 provides the ability for the curtain to extend horizontally beyond the window frame while mounting the alignment mounting bracket adjacent to the vertical portion of a window frame, which may correspond to the position of an underlying window stud. The second horizontal leg 40 extends from the first horizontal leg in a direction substantially perpendicular to the axial direction of the telescoping curtain rod 12, and includes an upper edge 42 and an end 44. The second horizontal leg 40 may also include support arm mounting holes 48 and 49. The first and second horizontal legs 30 and 40 may intersect to form an alignment intersection 46. The horizontal guide edge 32 of the first horizontal leg 30 may be substantially aligned with the upper edge 42 of the second horizontal leg 40.

As shown in FIGS. 2 and 3, the bracket assembly 19 has a vertical height H, a curtain extension distance L and a curtain overhang distance D selected to properly position the window curtain rod assembly 10 during installation around a window frame 2. The curtain extension distance L may be selected to allow the telescoping rod 12 and curtain to extend away from the exterior window frame sidewall 4 of the window frame 2 in a direction parallel with the axial direction of the telescoping curtain rod 12. The curtain extension distance L offsets the vertical guide edge 24 from the end 80 of the first rod section 14 and/or the rod abutment face 66 of the support arm 60 in a direction parallel with the axis of the telescoping curtain rod 12. For example, the curtain extension distance L of the bracket assembly 19 may typically range from 1 to 8 inches, or from 2 to 6 inches, or from 3 to 5 inches. The vertical height H of the alignment mounting bracket 20 may also be selected to properly position the window curtain rod assembly 10 during installation around a window frame 2. The vertical height H may be selected to provide the vertical guide edge 24 and to provide access to the alignment mounting bracket wall mounting holes 28 and 29. For example, the vertical height H may range from 0.5 to 4 inches, or from 1 to 3 inches, or from 1.5 to 2.5 inches. The curtain overhang distance D of the bracket assembly 19 may also be selected to properly position the telescoping rod 12 away from the wall. The curtain overhang distance D offsets the vertical guide leg 22 from the axis of the telescoping curtain rod 12 in a direction perpendicular to the axis of the telescoping curtain rod. For example, the curtain overhang distance D may typically range from 0.5 to 8 inches, or from 1 to 6 inches, or from 1.5 to 4.5 inches.

As shown in FIG. 1, the vertical guide edge 24 of the alignment mounting bracket 20 may be positioned to align with the exterior window frame sidewall 4 of the window frame 2. The vertical guide edge 24 may be positioned directly adjacent to the exterior window frame sidewall 4 of a window frame 2. When the vertical guide edge 24 is positioned to align with the exterior window frame sidewall 4 of a window frame 2, this arrangement may provide for the alignment mounting bracket to be mounted on an underlying window stud. Alternatively, the vertical guide edge may be positioned directly above the exterior window frame sidewall 4 of a window frame 2. As shown in FIG. 1, the horizontal guide edge 32 of the mounting alignment bracket 20 may be positioned to align with the top edge 5 of the window frame 2. Alternatively, a user may desire to position the window curtain rod assembly higher than the top edge 5 of the window frame. Such positioning may be performed by aligning the vertical guide edge 24 with the exterior window frame sidewall 4 of a window frame 2. The use of the vertical guide edge 24 and/or the horizontal guide edge 32 provides for installation of the window curtain rod assembly 10 without the need to measure.

When the alignment mounting bracket 20 is positioned adjacent to the exterior window frame sidewall 4 or vertical portion of a window frame 2, the curtain extension distance L of the alignment mounting bracket 20 provides for the telescoping curtain rod 12 and the curtain to extend beyond the exterior window frame sidewall 4 or vertical portion of a window frame 2. This curtain extension distance L is desirable to provide a light-blocking function in which the side edge of the curtain overlaps the window frame and for aesthetics. The window curtain rod assembly 10 provides the light-blocking and aesthetic function, and provides the ability for the alignment bracket assembly 19 to be mounted on the window stud without measuring.

FIGS. 4-7 illustrate another alignment mounting bracket 20*a*. Similar element numbers are used in FIGS. 4-7 for common features that are present in the embodiment of FIGS. 1-3. As shown in FIGS. 4-7, the alignment mounting 20*a* of the vertical guide leg may have a vertical height H slightly longer than the embodiment shown in FIGS. 1-3. For example, vertical height H may typically range from 0.5 to 8 inches, or from 1 to 6 inches, or from 1.5 to 5 inches, or from 2 to 4 inches.

As shown in FIGS. 1-7, the alignment mounting bracket wall mounting holes 28 and 29 may be located at different locations depending on the vertical height H of the alignment mounting bracket 20 and 20*a*. In the embodiment shown in FIGS. 1-3, the upper alignment mounting bracket wall mounting hole 29 may be positioned near the horizontal guide edge 32, and the lower alignment mounting bracket wall mounting hole 28 may be positioned near the lower end 26 of the vertical guide leg 22. In the embodiment shown in FIGS. 4-7, the upper alignment mounting bracket wall mounting hole 29 may be positioned near a midpoint of the lower end 26 of the vertical guide leg 22 and the horizontal guide edge 32, and the lower alignment mounting bracket wall mounting hole 28 may be positioned near the lower end 26 of the vertical guide leg 22. However, any other suitable arrangement of bracket wall mounting holes 28 and 29 may be used.

Figure 10:
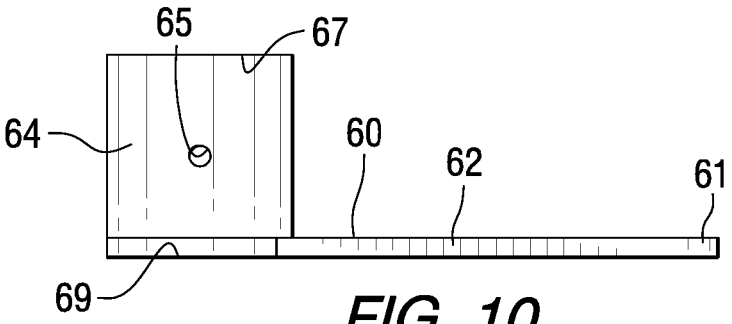
FIG. 10 is a bottom view of the support arm of FIG. 8.

The support arm 60 includes a first substantially cylindrical end 64 and a second end 61. The first substantially cylindrical end 64 defines an axis substantially aligned with the axis of the telescoping curtain rod 12. The second end 61 may be laterally offset from the first substantially cylindrical end 64 in a direction perpendicular to the axis of the telescoping rod and/or the axis of the first substantially cylindrical end 64. The first substantially cylindrical end 64 may include a rod abutment face 66, a rod receiving opening 67, and a finial abutment face 69. As more fully described below and illustrated in FIGS. 20-28, the finial abutment face 66 may be provided with a magnet (not shown) for attaching a magnetic finial. The rod receiving opening 67 has a cylindrical surface with an inner diameter selected based upon the outer diameter of the end 80 of the first rod section 14 that it receives. The rod abutment face 66 may include a threaded finial hole 68. However, the finial hole 68 of the first support arm 60 may be non-threaded, or may be eliminated and replaced with a magnet in accordance with an embodiment of the present invention. A mounting section 62 may be provided between the first substantially cylindrical end 64 and the second end 61. As shown in FIG. 10, the first substantially cylindrical end 64 may include an optional threaded thumb screw hole 65. The thumb screw hole 65 may be configured to receive a mechanical fastener to contact the first rod section. The mechanical fastener may be a thumb screw, threaded bolt, threaded screw, or any other conventional type of mechanical fastener.

In accordance with an embodiment of the invention, the mounting section 62 of the support arm 60 includes a connection slot 63 configured to allow the alignment mounting bracket 20 to be slideably mounted on the second end 61 of the support. The alignment mounting bracket 20 being slideably mounted to the support arm 60 allows the curtain overhang distance D to be easily adjusted after installation. However, any other type of suitable mounting of the alignment bracket 20 to the support arm may be used, e.g., connection holes, welding, or the like. Alternatively, the alignment mounting bracket 20 and the support arm 60 may be fixed in relation to each other or integrally formed.

In FIGS. 1-3, a finial 70 is attached to the alignment bracket assembly 19. The finial 70 includes a collar 72, a bracket engaging face 74 and a threaded bolt 76. When the finial 70 is attached to the support arm 60, the threaded bolt 76 is substantially aligned with the axis of the first substantially cylindrical end 64 and the axis of the telescoping rod 12. The threaded bolt 76 is threadingly engaged with the threaded finial hole 68 in the abutment face 69 of the first support arm 60. Alternatively, the threaded bolt 76 may only pass through the finial hole 68. As shown in FIG. 3, the end 80 of the first rod section 14 includes an internal sleeve 82 with a threaded hole 83. The threaded bolt 76 is configured to be threadingly engaged with the threaded hole 83 of the sleeve 82. However, any other suitable shape and arrangement of engagement between the finial 70 and the end 80 of first rod section 14 may be used, e.g., pins, mechanical fasteners, clamps, snap-fit, adhesives, or the like. Alternatively, the finial 70 may not directly engage the end 80 of the first rod section 14, e.g., the end 80 of the first rod section 14 may only be engaged by the first substantially cylindrical end 64. For example, the end 80 of first rod section 14 may be engaged by the first substantially cylindrical end 64 using frictional engagement, pins, mechanical fasteners, clamps, snap-fit, adhesives, or the like.

Engagement of the threaded bolt 76 with the threaded finial hole 68 and the threaded hole 83 of the sleeve 82 of the end 80 of the first rod section 14 provides secure attachment. For example, the end 80 of the first rod section 14 engages the rod abutment face 64, the sleeve 82 may have a threading engagement with the threaded bolt 76, a mechanical fastener may contact the end 80 of the first rod section 14 through the thumb screw hole 65, and the bracket engaging face 74 engages the finial abutment face 69 of the first substantially cylindrical end 64 of the support arm 60. This arrangement results in the first rod section 14 being rigidly secured in the support arm 60.

As shown FIGS. 1-7, the alignment mounting bracket 20 may be secured to the wall with mechanical fasteners 50 and 51 through alignment mounting bracket wall mounting holes 28 and 29. In the embodiment shown, the mechanical fasteners 50 and 51 are threaded screws, however, any other suitable type of mechanical fasteners may be used, e.g., bolts or any other conventional type of mechanical fastener. In accordance with certain embodiments, the mechanical fasteners may be self-tapping screws to secure the alignment mounting bracket 20 into metal and/or wood window studs. In accordance with certain embodiments, the mechanical fasteners may be secured using optional wall anchors 52. However, as described above, when the mounting bracket 20 is positioned adjacent to the window frame, a window stud is likely to be provided at such a location and the use of the wall anchors 52 may not be necessary. As shown in FIGS. 1-3, the alignment mounting bracket 20 may be secured to the support arm 60 with mechanical fasteners 54 and 55 through the alignment mounting bracket 20 mounting holes 48 and 49, and the support arm 60 connection slot 63. In the embodiment shown, mechanical fasteners 50 is a threaded screw, however, any other suitable type of mechanical fastener may be used, e.g., a thumb screw, a bolt or any other conventional type of mechanical fastener.

As shown in FIG. 2, the window curtain rod assembly 10 includes a rod section locking device 90 to fix the axial position of the first rod section 14 with respect to the second rod section 16, a first bushing 92 and a second bushing 94. The first and second bushings 92 and 94 provide for smooth axial movement between the rod sections. In the embodiment shown, the rod section locking device 90 is coupled to the second rod section 16 that is positioned inside the first rod section 14. In certain embodiments, the locking device 90 may include an axially offset cam and an eccentric sleeve around the cam, such that when the second rod section is rotated with respect to the first rod section, the eccentric sleeve pushes against an internal surface of the first rod section, thereby locking the axial position of the first rod section with respect to the second rod section. The rod section locking device 90 can be similar to the locking mechanisms disclosed in U.S. Patent Application Publication No. US2012/0005823A1 published Jan. 12, 2012, U.S. Patent Application Publication No. US2013/0112639A1 published May 9, 2013, and U.S. Pat. No. 8,814,114 issued Aug. 26, 2014, which are incorporated herein by reference. Other types of rod section locking devices may be used, such as those disclosed in U.S. Pat. No. 8,851,305 issued Oct. 7, 2014, and U.S. Pat. No. 8,960,456 issued Feb. 24, 2015, which are incorporated herein by reference. In another embodiment, the rod section locking device 90 may include at least one mechanical fastener to fix the relative position of the rod sections. Any suitable number and arrangement of rod section locking devices 90 may be used, e.g., locking devices may be provided between each rod section of the telescoping curtain rod, or there may be no rod section locking devices in the telescoping curtain rod.

In accordance with certain embodiments, the first rod section 14 and the second rod section 16 may be axially moveable and lockable with respect to each other, while the second rod section 16 and the third rod section 18 may be freely slideable with respect to each other. However, any other suitable arrangement of locking relationship may be used, e.g., the second rod section 16 and the third rod section 18 may be axially moveable and lockable with respect to each other, and/or the first rod section 14 and the second rod section 16 may be freely axially moveable with respect to each other. Any number of rod sections may be axially moveable and lockable with respect to each other, or any number of rod sections may be axially moveable, but not lockable with respect to each other.

FIGS. 1-3 illustrate a second alignment bracket assembly 119 of the window curtain rod assembly 10 in accordance with an embodiment of the present invention. Similar element numbers are used in FIGS. 1-3 for common features that are present in the first alignment bracket assembly 19 of FIGS. 1-12. As shown in FIGS. 1-3, the alignment bracket assembly 119 includes an alignment mounting bracket 120 and a support arm 160. The alignment mounting bracket 120 may be a mirror image of the alignment mounting bracket 20 as described in the first alignment bracket assembly 19 as shown in FIGS. 1-7. The support arm 160 may be a mirror image of the support arm 60 as described in the first alignment bracket assembly 19 as shown in FIGS. 1-3 and 8-11 with a first substantially cylindrical end 164 sized to receive the end 84 of the third rod section 18.

As shown in FIGS. 1-3, the alignment mounting bracket 120 includes a vertical guide leg 124, a first horizontal leg 130 and a second horizontal leg 140. The vertical guide leg 122 includes a vertical guide edge 124, a lower end 126 and an upper end terminating at a horizontal guide edge 132. In accordance with an embodiment of the present invention, the vertical guide leg 122 may also include alignment mounting bracket wall mounting holes (not shown). The first horizontal leg 130 may extend from the vertical guide leg 122 in a direction substantially parallel with the axial direction of telescoping curtain rod 12, and includes a horizontal guide edge 132 and a window frame end terminating in the vertical guide edge 124. The second horizontal leg 140 extends from the first horizontal leg extending in a direction substantially perpendicular to the axial direction of the telescoping curtain rod 12, and includes an upper edge 142 and a room end 144. The second horizontal leg 140 may also include support arm mounting holes (not shown). The first and second horizontal legs 130 and 140 intersect to form an alignment intersection 146. The horizontal guide edge 132 of the first horizontal leg 130 may be substantially aligned with the upper edge 142 of the second horizontal leg 140. The alignment mounting bracket 120 of the second alignment bracket assembly 119 may be of the same or similar construction as the alignment mounting bracket 20 as described in the first alignment bracket assembly 19 as shown in FIGS. 1-17.

As shown in FIGS. 1-3, a support arm 160 may be attached to the alignment mounting bracket 120 of the alignment bracket assembly 119. The support arm 160 includes a first substantially cylindrical end 164 and a second end 161. The first substantially cylindrical end 164 defines an axis substantially aligned with an axial direction of the telescoping curtain rod 12. The second end 162 may be laterally offset from the first substantially cylindrical end 164 in a direction substantially perpendicular to the axis of the telescoping curtain rod 12 and/or the axis of the first substantially cylindrical end 164. The first substantially cylindrical end 164 may include a rod abutment face 166, a rod receiving opening 167 having an inner diameter selected based upon the outer diameter of the rod section that it receives, and a finial abutment face 169. The rod abutment face 66 may include a threaded finial hole 168. A mounting section 162 may be provided between the first substantially cylindrical end 164 and the second end 161. The mounting section 162 of the support arm 160 may include a connection slot 163 configured to allow the alignment mounting bracket 120 to be slideably mounted on the second end 61 of the support. The first substantially cylindrical end 64 may include an optional threaded thumb screw hole (not shown). The support arm 160 of the second alignment bracket assembly may be of the same or similar construction as the alignment mounting bracket 60 as described in the first alignment bracket assembly 19.

As shown in FIGS. 1-3, the alignment bracket assembly 119 has a vertical height, a curtain extension distance and a curtain overhang distance selected to properly position the window curtain rod assembly 10 during installation around a window frame 2. When the alignment mounting bracket 120 is positioned adjacent to the exterior window frame sidewall 4 or vertical portion of a window frame 2, the curtain extension distance of the alignment bracket assembly 119 provides for the telescoping curtain rod 12 and the curtain to extend beyond the exterior window frame sidewall 4 or vertical portion of a window frame 2. This curtain extension distance L is desirable to provide a light-blocking function in which the side edge of the curtain overlaps the window frame and for aesthetics. The window curtain rod assembly 10 provides the light-blocking and aesthetic function, and provides the ability for the alignment bracket assembly 119 to be mounted on the window stud without measuring. The vertical height, a curtain extension distance and a curtain overhang distance of the alignment bracket assembly 119 may be the same or similar to the vertical height H, the curtain extension distance L and the curtain overhang distance D of the alignment bracket assembly 19.

As shown in FIGS. 1-3, a finial 170 may also be attached to the alignment bracket assembly 119. The finial 170 includes a collar 172, a bracket engaging face 174 and a threaded bolt 176. The finial 170 of the second alignment bracket assembly 119 may be of the same or similar construction as the finial 70 as described in the first alignment bracket assembly 19.

In accordance with an embodiment, the end 84 of the third rod section 18 may include a sleeve 86 with a threaded hole 87. The end 84 of the third rod section 18 may engage the second alignment bracket assembly 119 and the finial 170 using the same or similar engagement arrangements as described between the end 80 of the first rod section 14 and the first alignment bracket assembly 19 and the finial 70.

As shown in FIGS. 1-3, the alignment mounting bracket 120 may be secured to the wall with mechanical fasteners 150 and 151 through alignment mounting bracket wall mounting holes (not shown). In accordance with certain embodiments, the mechanical fasteners may be secured using optional wall anchors 152. As shown in FIGS. 1-3, the alignment mounting bracket 120 may be secured to the support arm 160 with mechanical fasteners 154 and 155 through the support arm mounting holes (not shown) and the alignment mounting bracket connection slot 163. The mechanical fasteners 150, 151, 154 and 155 of the second alignment bracket assembly may be of the same or similar construction as the mechanical fasteners 50, 51, 54 and 55 as described in the first alignment bracket assembly 19.

In accordance with certain embodiments, the end 80 of the first rod section 14 and the end 84 of the third rod section 18 may be secured in the support arms 60 and 160 to prevent axial movement, and the rod section locking device 90 may fix the axial position of the intermediate rod section 16 with respect to the first rod section 14. For example, the end 80 of the first rod section 14 and the end 84 of the third rod section 18 may be inserted and secured in their corresponding first substantially cylindrical ends 64 and 164 by a threading engagement with the threaded bolts 76 and 176 of the finials 170 and 174. The intermediate or second rod section 16 between the first rod section 14 and the third rod section 18 has its axial movement in relation to the first rod section 14 fixed by the rod section locking device 90. This arrangement prevents the rod sections 14, 16 and 18 from axially moving in relation to each other when a curtain is pulled across the telescoping curtain rod 12. This represents an advantage over freely slideable telescoping rods that may move with a curtain when it is pulled axially across the telescoping curtain. The telescoping rod 12 having three sections also provides for the ability for the window curtain rod assembly 10 to cover a large range of window opening/frame widths. For example, a relatively short telescoping rod 12 may expand from 18 inches to 4 feet, and a relatively long telescoping rod may expand from 4 feet to 10 feet, thereby providing coverage for almost any standard-sized window by selecting either the shorter or longer version of the telescoping rod 12.

To install the window curtain rod assembly 10, the alignment mounting bracket 20 of the first alignment bracket assembly 19 may be positioned along a first vertical portion of a window frame 2 and mounted, e.g., on an underlying window stud. The alignment mounting bracket 120 of the second alignment bracket assembly 119 may be positioned along an opposite vertical portion of a window frame 2 and mounted on an opposite window stud. The end 80 of the first rod section 14 may be inserted into the first substantially cylindrical end 64 of the support arm 60 of the first alignment bracket assembly 19. The threaded bolt 76 of the finial 70 may be inserted through the finial hole 68 of the rod abutment face 66 and engaged with the threaded hole 83 of the threaded sleeve 82 at the end 80 of the first rod section 14. The end 84 of the third rod section 18 may be inserted into the first substantially cylindrical end 164 of the support arm 160 of the second bracket assembly 119. The first rod section 14 may then be axially locked with respect to the second rod section 16. The threaded bolt 176 of the finial 170 may be inserted through the finial hole 168 of the rod abutment face 166 and engaged with the threaded hole 87 of the threaded sleeve 86 at the end 84 of the third rod section 18.

FIGS. 12-19 illustrate a window curtain rod assembly 210 mounted over a window frame 202 in accordance with another embodiment. In this embodiment, similar element numbers are used to describe similar features found in the previous embodiments. The window curtain rod assembly 210 includes a telescoping curtain rod 212, a first alignment bracket assembly 219 and a second alignment bracket assembly 319. As shown in FIGS. 12-15, the telescoping curtain rod 212 comprises a first telescoping rod section 214 (also called a first end rod section), a second telescoping rod section 216 (also called an intermediate rod section) and a third telescoping rod section 218 (also called a second end rod section). The first, second and third rod sections of this embodiment may be of the same or similar construction as the first, second and third rod sections as described in the previous embodiments.

The window curtain tension rod assembly 210 includes a rod section locking device (not shown), first bushing (not shown) and second bushing 294. The rod section locking device and first and second bushings of the present embodiment may be of the same or similar construction as the rod section device 90 as described in the previous embodiments as shown in FIGS. 1-11.

Figure 14:
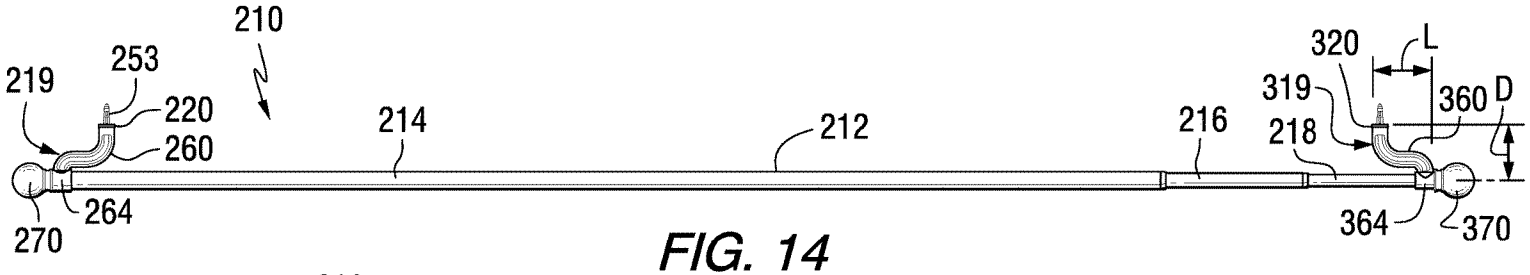
FIG. 14 is a top view of the window curtain rod assembly of FIG. 12.
Figure 15:
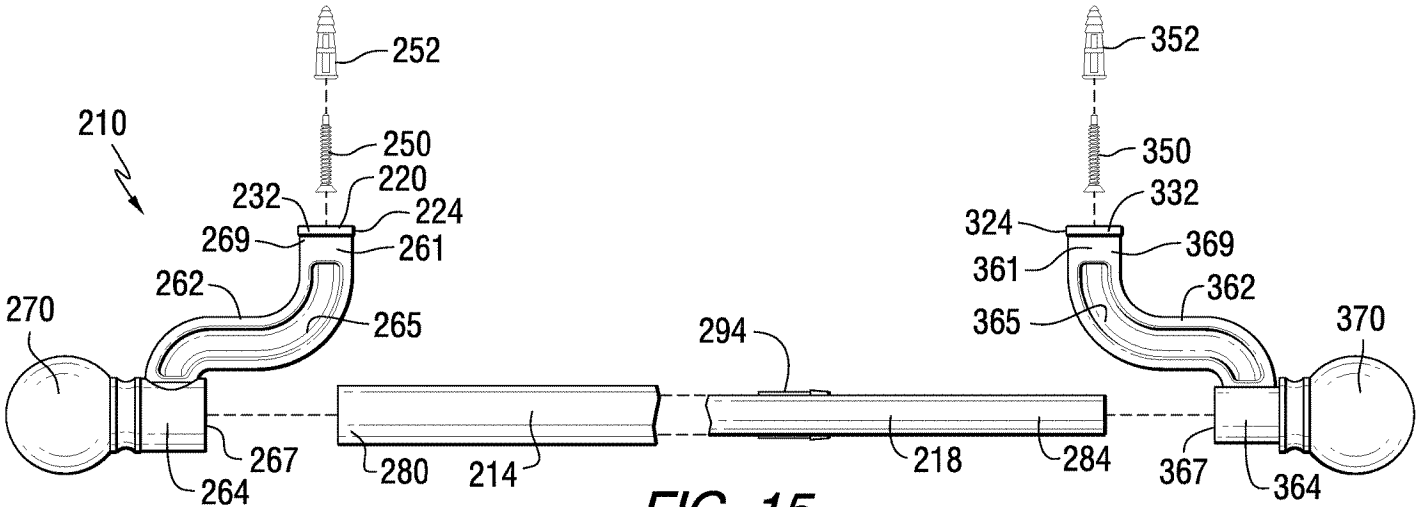
FIG. 15 is a top exploded view of the bracket assemblies of the window curtain rod assembly of FIG. 14.
Figure 16:
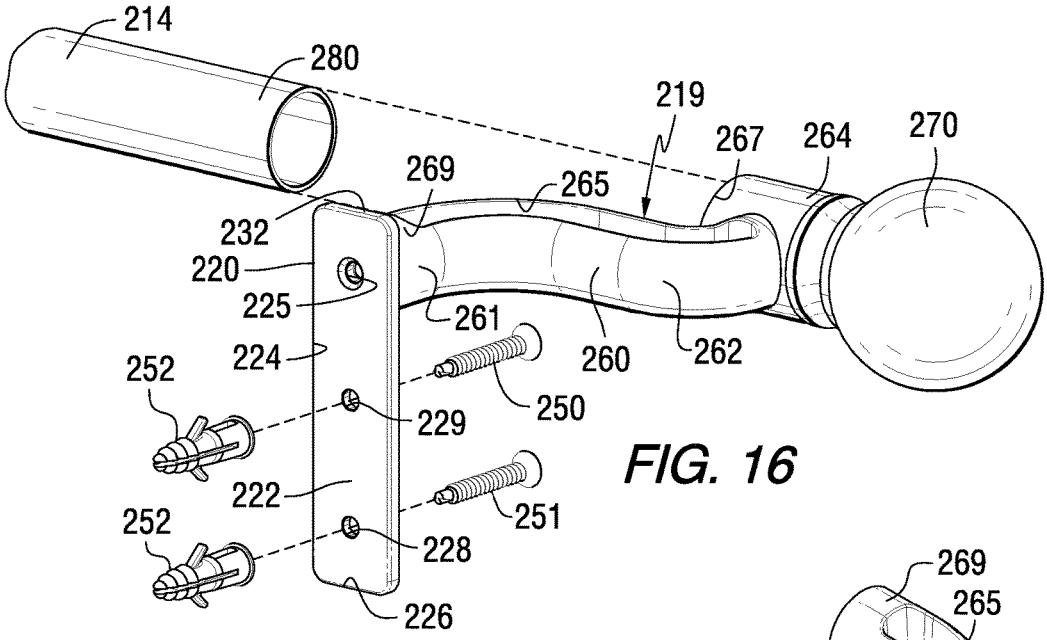
FIG. 16 is an isometric exploded view of an alignment bracket assembly.
Figure 17:
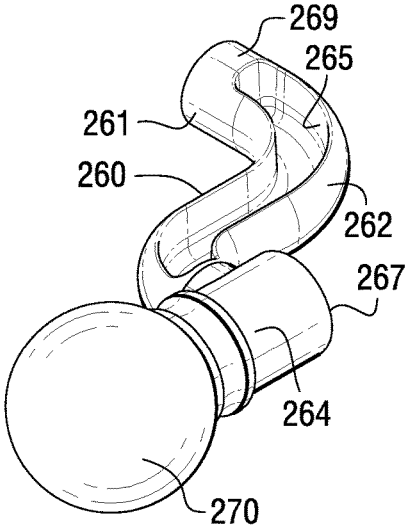
FIG. 17 is an isometric view of a support arm of an alignment bracket assembly.

As shown in FIGS. 12-16, the first alignment bracket assembly 219 includes an alignment mounting bracket 220 and a support arm 260. The alignment mounting bracket 220 includes a vertical guide leg 222. The vertical guide leg 222 may include a vertical guide edge 224, a lower end 226 and an upper end terminating at a horizontal guide edge 232. As shown in FIG. 16, the vertical guide leg 222 may also include alignment mounting bracket wall mounting holes 228 and 229 and support arm mounting hole 225.

Figure 13:
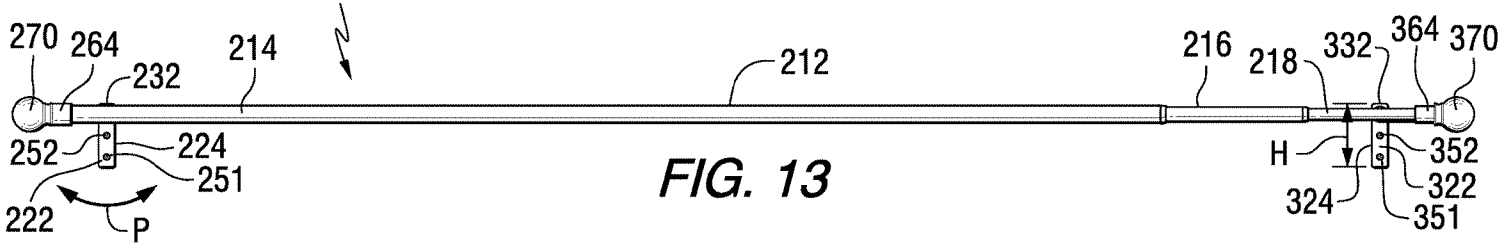
FIG. 13 is a front view of the window curtain rod assembly of FIG. 12.

As shown in FIGS. 13 and 14, the first alignment bracket assembly 219 has a vertical height H, a curtain extension distance L and a curtain overhang distance D selected to properly position the window curtain rod assembly 210 during installation around a window frame 2. The curtain extension distance L may be selected to allow the telescoping rod 212 and curtain to extend away from the exterior window frame sidewall 204 of the window frame 202 in a direction parallel with the axial direction of the telescoping curtain rod 212. The curtain extension distance L offsets the vertical guide edge 224 from the end 280 of the first rod section 214 and/or the rod abutment face 266 of the support arm 260 in a direction parallel with the axis of the telescoping curtain rod 212. For example, the curtain extension distance L of the first alignment bracket assembly 219 may typically range from 1 to 8 inches, or from 1.5 to 6 inches, or from 2 to 5 inches. The vertical height H of the first alignment bracket assembly 219 may also be selected to properly position the window curtain rod assembly 210 during installation around a window frame 202. The vertical height H may be selected to provide the vertical guide edge 224, and access to the alignment mounting bracket wall mounting holes 228 and 229 and support arm mounting hole 225. For example, vertical height H may typically range from 1 to 6 inches, or from 1.5 to 5.5 inches, or from 2 to 4 inches. The curtain overhang distance D of the first alignment bracket assembly 219 may also be selected to properly position the telescoping rod 12 away from the wall when installed. The curtain overhang distance D offsets the vertical guide leg 222 from the axis of the telescoping curtain rod 212 in a direction perpendicular to the axis of the telescoping curtain rod. For example, the room depth D may typically range from 0.5 to 6 inches, or from 1 to 5 inches, or from 1.5 to 4 inches.

Figure 12:
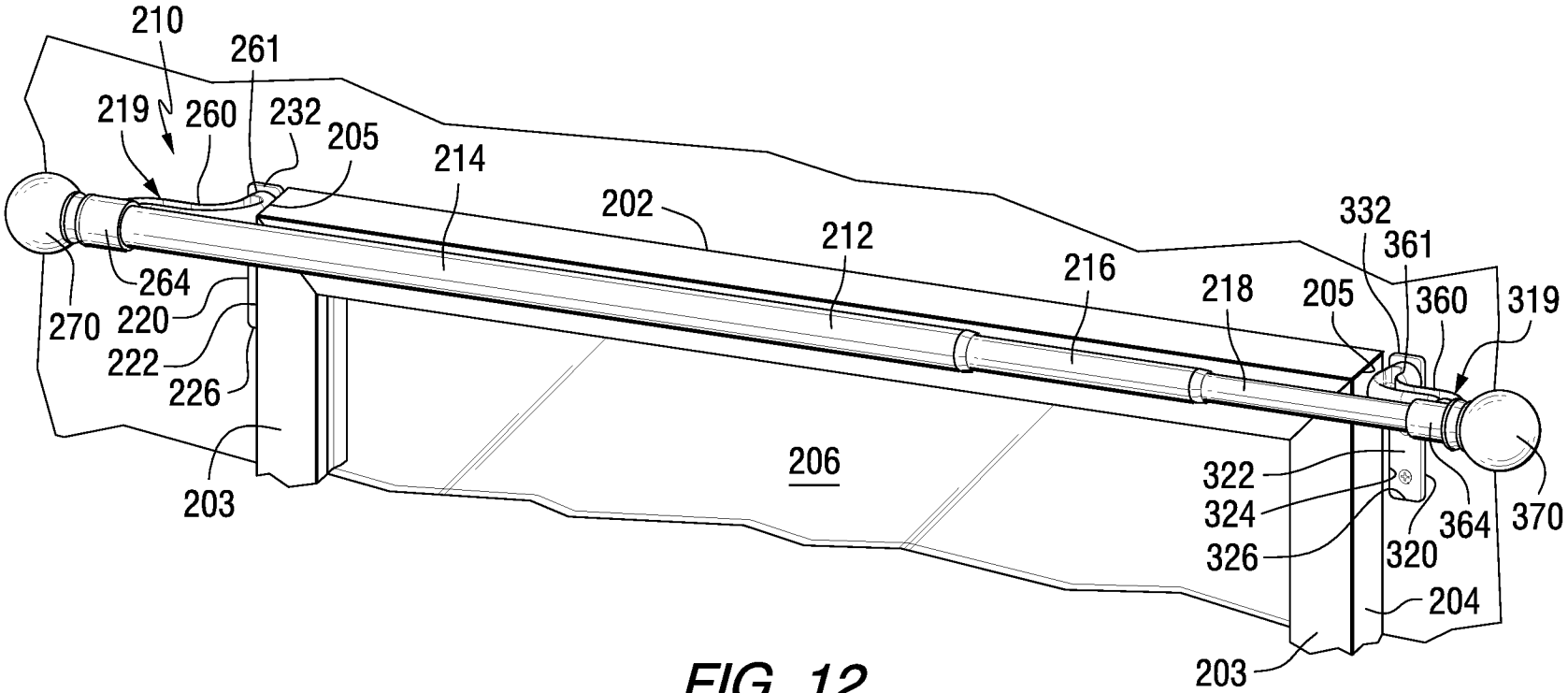
FIG. 12 is an isometric view of another window curtain rod assembly illustrating the window curtain rod assembly mounted around a window frame.

As shown in FIG. 12, the vertical guide edge 224 of the alignment mounting bracket 220 may be positioned to align with the exterior window frame sidewall 204 of the window frame 202. The vertical guide edge 24 may be positioned directly adjacent to the exterior window frame sidewall 204 of the window frame 202. When the vertical guide edge 224 is positioned to align with the exterior window frame sidewall 4 of a window frame 202, this arrangement may provide for the alignment mounting bracket to be mounted on the window stud. The curtain extension distance L provides the ability for the curtain to extend beyond the window frame while mounting the alignment mounting bracket on the window stud adjacent to the exterior window frame sidewall of a window frame. In another embodiment, the vertical guide edge may be positioned directly above the exterior window frame sidewall or vertical portion of a window frame 2. As shown in FIG. 12, the horizontal guide edge 232 of the mounting alignment bracket 220 may be positioned to align with the top edge 205 of the window frame 202. In another embodiment, a user may desire to position the window curtain rod assembly higher than the top edge 205 of the window frame. Such positioning may be performed by aligning the vertical guide edge 224 with the exterior window frame sidewall 4 or vertical portion of a window frame 2. The use of the vertical guide edge 24 and/or the horizontal guide edge 232 provides for installation of the window curtain rod assembly 210 without the need to measure.

As shown in FIGS. 12-19, the support arm 260 includes a first substantially cylindrical end 264 and a second end 261. The first substantially cylindrical end 264 defines an axis substantially aligned with the axis of the telescoping curtain rod 212. The second end 261 may be laterally offset from the first substantially cylindrical end 264 in a direction parallel with the axis of the telescoping curtain rod 212, and also in a direction perpendicular to the axis of the telescoping curtain rod 212. The first substantially cylindrical end 264 includes a rod receiving opening 267 having a cylindrical inner surface with an inner diameter selected based upon the outer diameter of the rod section that it receives and a rod abutment face 266. The first substantially cylindrical end 264 includes a decorative finial 270. In accordance with an embodiment of the present invention, the integral finial 270 may be replaced with a magnetic removable finial. The second end 261 of the support arm 260 includes a threaded alignment mounting bracket hole 263. The hole 263 is used to rotatably mount the mounting alignment bracket 220 onto the support arm 260, as more fully described below. In another embodiment, the alignment mounting bracket hole 263 may not be threaded.

As shown in FIGS. 12, 14, 15-17 and 18, the support arm 260 may have a generally "S"-shaped section 262 extending from the first substantially cylindrical end 264 to the second end 261. The generally S-shaped section 262 includes an upper edge 269. In accordance with an embodiment of the present invention, the upper edge 269 may be substantially aligned with the horizontal guide edge of the horizontal guide edge 232 of the alignment mounting bracket 220. The S-shaped section 262 may comprise an upwardly open recess 265. The recess 265 may be provided on the S-shaped section 262 in order to eliminate unnecessary material. In the embodiment shown, the S-shaped section 262 includes a single recess 265 encompassing the entire S-shaped section 262. However, any other suitable shape and arrangement of recesses may be used, e.g., the S-shaped section 262 may have a plurality of recesses, and/or the recess may encompass a portion of the S-shaped section.

Figure 19:
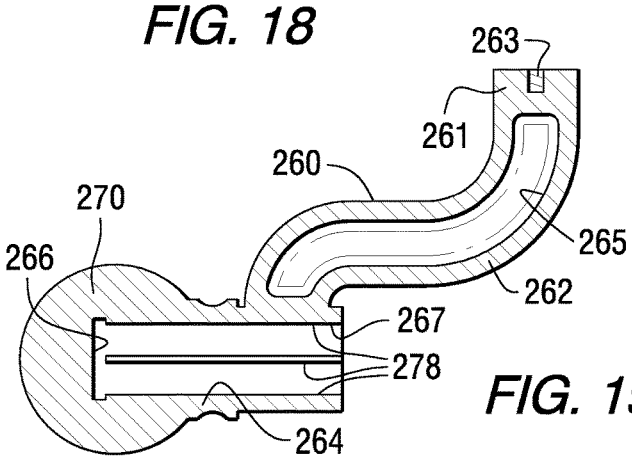
FIG. 19 is a partially schematic top cross-sectional view of FIG. 18.

As shown in FIG. 13, the alignment mounting bracket 220 and the support arm 260 may be moveably mounted. In accordance with an embodiment of the present invention, the alignment mounting bracket 220 may pivotably P attached to the second end 261 of the support arm 260. As shown in FIGS. 16 and 19, the alignment mounting bracket 220 may be rotatably attached to the second end 261 of the support arm 260 by inserting a mechanical fastener through support arm mounting hole 225 into threaded alignment mounting bracket hole 263. This arrangement allows the mounting bracket 220 to rotate in relation to the support arm 260 in order to facilitate adjustments when installing on non-uniform window frames, and to allow the mounting bracket to rotate 90° when packaged to reduce its packaging depth requirements. In accordance with certain embodiments, the support arm mounting hole 225 may be countersunk so that the mechanical fastener can be inserted flush with the surface of the alignment mounting bracket 220. Alternatively, the alignment mounting bracket 220 and the support arm 260 may be fixed in relation to each other or integrally formed.

Figure 18:
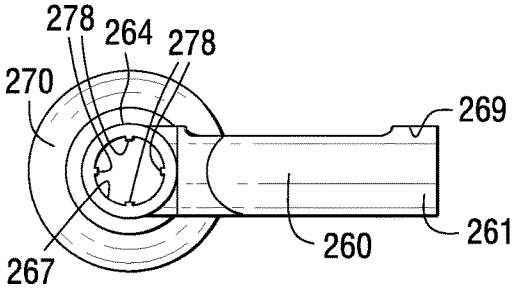
FIG. 18 is a partially schematic side view of the support arm of FIG. 17.

As shown in FIGS. 18 and 19, the first substantially cylindrical end 264 of the support arm 260 of the first alignment bracket assembly 219 comprises at least one radially inwardly extending friction rib 278 running substantially parallel with the axial direction of the telescoping curtain rod 212. In the embodiment shown, there are four friction ribs 278, but any other suitable number of friction ribs may be used. For example, there may be zero, one, two, three, four or more friction ribs. In accordance with embodiments of the present invention, the friction ribs 278 are provided in order to provide controlled frictional engagement between the end 280 the first rod section 214 and the first substantially cylindrical end 264 once the rod is inserted. In accordance with an embodiment, the end 280 of the first rod section 214 is frictionally held in the first substantially cylindrical end 264 of the support rod 260 by contact between at least a portion of an outer diameter the first rod section 214 with either an inner diameter of the first substantially cylindrical end 264 or at least one radially inwardly projecting rib 248, as shown in FIGS. 18 and 19, extending from the inner diameter of the first substantially cylindrical end. However, any other suitable shape and arrangement of engagement between the end 80 of the first rod section 214 and the first substantially cylindrical end 264 may be used, e.g., pins, mechanical fasteners, clamps, snap-fit, adhesives, or the like. In accordance with an embodiment, when the end 80 of the first rod section 214 is inserted into the first substantially cylindrical end 264 of the support arm 260, the end 280 contacts the rod abutment face 266.

As shown in FIGS. 15 and 16, the alignment mounting bracket 220 may be secured to the wall with mechanical fasteners 250 and 251 through alignment mounting bracket wall mounting holes 228 and 229. In the embodiment shown, the mechanical fasteners 250 and 251 are threaded screws, however, any other suitable type of mechanical fasteners may be used, e.g., bolts or any other conventional type of mechanical fastener. In accordance with certain embodiments, the mechanical fasteners may be self-tapping screws to secure the alignment mounting bracket 220 into metal and/or wood window studs. In accordance with certain embodiments, the mechanical fasteners may be secured using optional wall anchors 252.

FIGS. 12-15 illustrate a second alignment bracket assembly 319 of the window curtain rod assembly 210. Similar element numbers are used in FIGS. 12-15 for common features that are present in the first alignment bracket assembly 219 of FIGS. 12-16. As shown in FIGS. 12-15, the alignment bracket assembly 319 includes an alignment mounting bracket 320 and a support arm 360. The alignment mounting bracket 320 may be a mirror image of the alignment mounting bracket 220 as described in the first alignment bracket assembly 219 as shown in FIGS. 12-16. The support arm 360 may be a mirror image of the support arm 260 as described in the first alignment bracket assembly 219 as shown in FIGS. 12-19 with a first substantially cylindrical end 364 sized to receive the end 284 the third rod section 218.

As shown in FIGS. 12-15, the alignment mounting bracket 320 includes a vertical guide leg 322. In accordance with an embodiment, the vertical guide leg 322 may include a vertical guide edge 324, a lower end 326 and an upper end terminating at a horizontal guide edge 332. In accordance with an embodiment, the vertical guide leg 322 may also include alignment mounting bracket wall mounting holes (not shown) and support arm mounting hole (not shown). The alignment mounting bracket 320 of the second alignment bracket assembly 319 may be of the same or similar construction as the alignment mounting bracket 220 as described in the first alignment bracket assembly 219 as shown in FIGS. 12-16.

As shown in FIGS. 12-15, the support arm 360 may be attached to the alignment mounting bracket 320 of the alignment bracket assembly 319. The support arm 360 includes a first substantially cylindrical end 364 and a second end 361. The first substantially cylindrical end 264 defines an axis substantially aligned with the axis of the telescoping curtain rod 212. The second end 361 may be laterally offset from the first substantially cylindrical end 364 in a direction substantially parallel with the axis of the telescoping curtain rod 212, and also in perpendicular to the axis of the telescoping curtain rod 212. The first substantially cylindrical end 364 includes a rod receiving opening 367 having cylindrical inner surface with an inner diameter selected based upon the outer diameter of the rod section that it receives and a rod abutment face 366. In accordance with certain embodiments, the first substantially cylindrical end 364 may also include a decorative finial 370. The second end 361 of the support arm 360 includes an optionally threaded alignment mounting bracket hole (not shown). The alignment mounting bracket 220 may be secured to the wall with mechanical fasteners 350 and 351 through alignment mounting bracket wall mounting holes. The support arm 360 of the second alignment bracket assembly 319 may be of the same or similar construction as the support arm 360 as described in the first alignment bracket assembly 219 as shown in FIGS. 12-16.

As shown in FIGS. 12-15, the alignment bracket assembly 319 has a vertical height, a curtain extension distance and a curtain overhang distance selected to properly position the window curtain rod assembly 210 during installation around a window frame 202. When the alignment mounting bracket 320 is positioned adjacent to the exterior window frame sidewall 204 or vertical portion of a window frame 202, the curtain extension distance of the alignment bracket assembly 319 provides for the telescoping curtain rod 212 and the curtain to extend beyond the exterior window frame sidewall 4 or vertical portion of a window frame 2. This curtain extension distance L is desirable to provide a light-blocking function in which the side edge of the curtain overlaps the window frame and for aesthetics. The window curtain rod assembly 210 provides the light-blocking and aesthetic function, and provides the ability for the alignment bracket assembly 319 to be mounted on the window stud without measuring. The vertical height, a curtain extension distance and a curtain overhang distance of the alignment bracket assembly 319 may be the same or similar to the vertical height H, a curtain extension distance L and a curtain overhang distance D of the alignment bracket assembly 219.

As shown in FIGS. 12, 14 and 15, the support arm 360 may have a generally "S"-shaped section 362 extending from the first substantially cylindrical end 364 to the second end 361. The generally S-shaped section 362 may include an upper edge 369. In accordance with an embodiment of the present invention, the upper edge 369 may be substantially aligned with the horizontal guide edge of the horizontal guide edge 332 of the alignment mounting bracket 320. The S-shaped section 362 may comprise an upwardly open recess 365. The support arm 360 of the second alignment bracket assembly 319 may be of the same or similar construction as the support arm 360 as described in the first alignment bracket assembly 219 as shown in FIGS. 12-16.

The alignment mounting bracket 320 and the support arm 360 may be movably mounted. The mounting between the alignment mounting bracket 320 and the support arm 360 may performed with the same or similar arrangements as the alignment mounting bracket 220 and the support arm 260 as described in the first alignment bracket assembly 219 as shown in FIGS. 12-16.

The end 284 of the third rod section 218 may be engaged with the first substantially cylindrical end 364 of the support arm 360 using the same or similar engagement arrangements as described between the end 280 of the first rod section 214 and the first substantially cylindrical end 264 of the support arm 260.

To install the window curtain rod assembly 210, the alignment mounting bracket 220 of the first alignment bracket assembly 219 may be positioned along a first vertical portion of a window frame 202 and mounted, e.g., on an underlying window stud. The alignment mounting bracket 320 of the second alignment bracket assembly 319 may be positioned along an opposite vertical portion of a window frame 202 and mounted on an opposite window stud. The end 280 of the first rod section 214 may be inserted into the first substantially cylindrical end 264 of the support arm 260 of the first alignment bracket assembly 219. The end 284 of the third rod section 218 may be inserted into the first substantially cylindrical end 364 of the support arm 360 of the second bracket assembly 319. The first rod section 214 may then be axially locked with respect to the second rod section 216.

FIGS. 20-28 illustrate features of a room darkening window curtain rod assembly 410 including removable finials 470 and 570 that is mounted over a window frame 402 in accordance with an embodiment of the present invention. In this embodiment, similar element numbers are used to describe similar features found in the previous embodiments.

Figure 20:
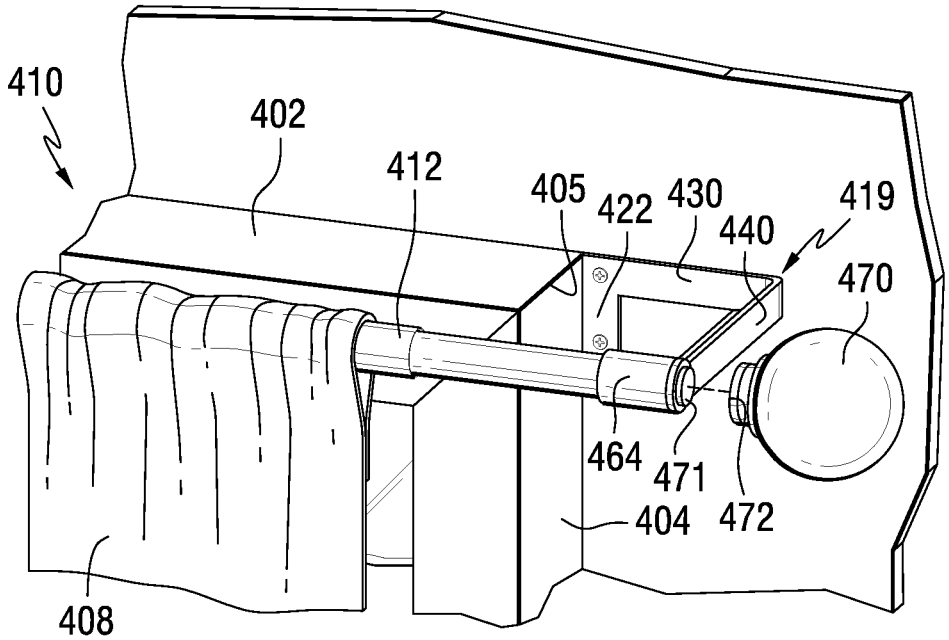
FIG. 20 is an isometric view of a window curtain rod assembly including a mounting bracket with a removable finial in accordance with an embodiment of the present invention, illustrating a portion of the window curtain rod assembly mounted around a window frame.
Figure 21:
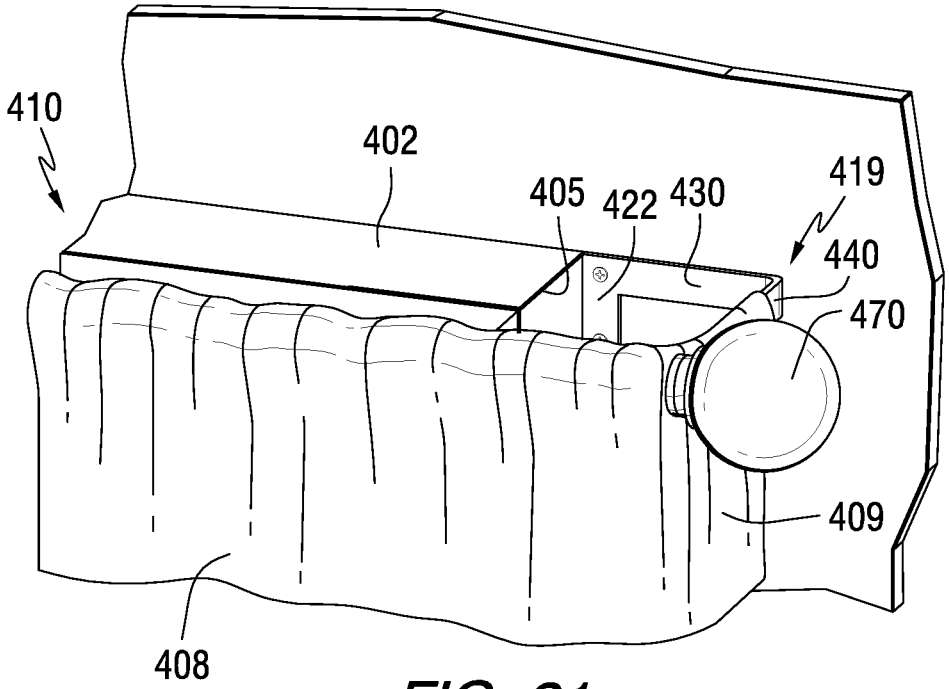
FIG. 21 is an isometric view of the window curtain rod assembly of FIG. 20 with a curtain wrapped around a laterally extending bracket portion and finial contacting the curtain and magnetically attached to the bracket in accordance with an embodiment of the invention.

As shown in FIGS. 20 and 21, the window curtain rod assembly 410 comprises a removable magnetic finial 470 that allows a curtain 408 to be drawn onto the bracket assembly 419 from the curtain rod 412 to provide a curtain wraparound region 409. The assembly includes a bracket having a vertical leg 422, a first horizontal leg 430, and a second horizontal leg or wraparound leg 440 that supports the curtain 408 above the wraparound leg 440 of the wraparound region 409. As shown in FIG. 20, before the window curtain 408 is pulled to cover the bracket assembly 419, the removable magnetic finial 470 is detached from the bracket assembly 419. As shown in FIG. 21, after the curtain 408 is drawn onto the bracket assembly 419, the removable magnetic finial 470 is attached to the bracket assembly 419 with the wraparound region 409 of the curtain 408 therebetween to completely cover the exterior window frame sidewall 404 of the window frame 402, and to hide the bracket assembly 419 from view. Thus, the curtain wraparound region 409 supported by the wraparound leg 440 reduces or prevents light from entering into the room, and allows the bracket assembly 419 to be hidden. As more fully described below, the wraparound leg 440 provides a curtain overhang distance D, and the first horizontal leg 430 provides a curtain extension distance L, which may be selected to provide a desired room darkening effect. The curtain 408 may be of any known design and may typically comprise two curtain panels that may each be drawn onto one of the bracket assemblies of the present invention to provide a room darkening effect. However, other types of curtains including single panel curtains may be used.

Figure 22:
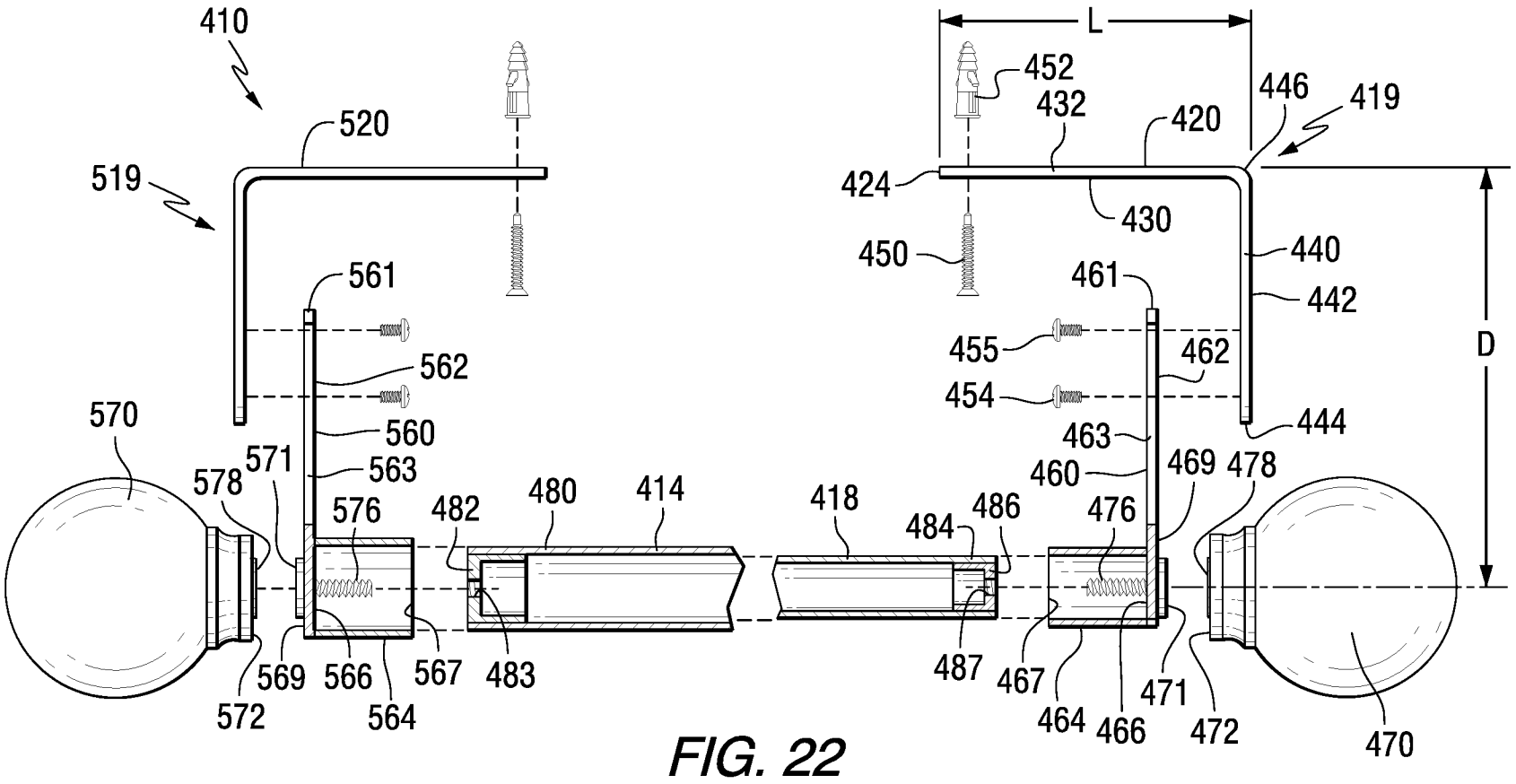
FIG. 22 is a top exploded view of a window curtain rod assembly including removable finials in accordance with an embodiment of the invention.

In accordance with an embodiment of the present invention, the window curtain rod assembly 410 includes a telescoping curtain rod 412, a first bracket assembly 419 and a second bracket assembly 519. As shown in FIG. 22, the telescoping curtain rod 412 comprises a first telescoping rod section 414 (also called a first rod section) and a second telescoping rod section 418 (also called a second rod section). The first and second rod sections of this embodiment may be of the same or similar construction as the first, second and third rod sections as described in the previous embodiments.

The window curtain tension rod assembly 410 includes a rod section locking device (not shown), first bushing (not shown) and second bushing (not shown). The rod section locking device and first and second bushings of the present embodiment may be of the same or similar construction as the rod section device 90 as described in the previous embodiments of FIGS. 1-11.

As shown in FIG. 20, the vertical guide edge 424 of the alignment mounting bracket 420 may be positioned to align with the exterior window frame sidewall 404 of the window frame 402. In accordance with an embodiment of the present invention, the vertical guide edge 424 may be positioned directly adjacent to the exterior window frame sidewall 404 of a window frame 402. When the vertical guide edge 424 is positioned to align with the exterior window frame sidewall 404 of a window frame 402, this arrangement may provide for the alignment mounting bracket to be mounted on an underlying window stud. In another embodiment, the vertical guide edge may be positioned directly above the exterior window frame sidewall 404 of a window frame 402. As shown in FIG. 20, the horizontal guide edge 432 of the mounting bracket 420 may be positioned to align with the top edge 405 of the window frame 402. In another embodiment, a user may desire to position the window curtain rod assembly higher than the top edge 405 of the window frame. Such positioning may be performed by aligning the vertical guide edge 424 with the exterior window frame sidewall 404 of a window frame 402. The use of the vertical guide edge 424 and/or the horizontal guide edge 432 in accordance with an embodiment of the present invention provides for installation of the window curtain rod assembly 410 without the need to measure.

Figure 23:
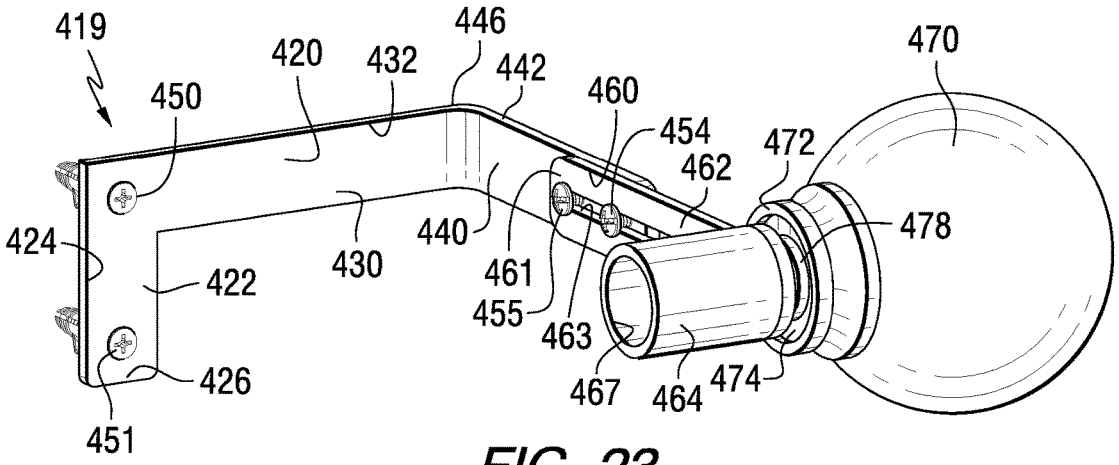
FIG. 23 is an isometric view of a window curtain rod bracket assembly including a removable finial in accordance with an embodiment of the present invention.

In the embodiment as shown in FIGS. 22 and 23, the first bracket assembly 419 comprises a two-piece design including an alignment mounting bracket 420 and a support arm 460. In this embodiment, the wraparound leg 440 also includes the support arm 460 to provide an adjustable curtain overhang distance D. While a two-piece mounting bracket 420 and a support arm 460 arrangement is shown in FIGS. 22 and 23, it is to be understood that a one-piece or integral mounting bracket 419 may be used, as shown in FIGS. 20 and 21. The alignment mounting bracket 420 includes a vertical guide leg 422, a first horizontal leg 430 and a second horizontal leg 440 which, in combination with the support arm 460, provides an adjustable wraparound leg, that extends laterally between the first horizontal leg 430 and a generally cylindrical end 464 of the bracket support arm 460. The vertical guide leg 422 includes a vertical guide edge 424, a lower end 426 and an upper end terminating at a horizontal guide edge 432. As shown in FIG. 23, the vertical guide leg 422 may also include alignment mounting bracket wall mounting holes 428 and 429. The first horizontal leg 430 may extend from the vertical guide leg 422 in a direction substantially parallel with the axial direction of the telescoping curtain rod 412, and includes a horizontal guide edge 432 and a window frame end terminating in the vertical guide edge 424. The laterally extending second horizontal wraparound leg 440 extends from the first horizontal leg in a direction substantially perpendicular to the axial direction of the telescoping curtain rod 412, e.g., in a direction having a component that is perpendicular to the longitudinal axis of the rod and includes an upper edge 442 and an end 444. In the embodiments shown, the laterally extending second horizontal wraparound leg 440 extends at a 90° angle from the axis of the telescoping curtain rod 412. However, any other suitable extension angle having a component perpendicular to the axis may be used. The second horizontal wraparound leg 440 may also include support arm mounting holes 448 and 449. The first and second horizontal legs 430 and 440 may intersect to form an alignment intersection 446. In accordance with certain embodiments of the present invention, the horizontal guide edge 432 of the first horizontal leg 430 may be substantially aligned with the upper edge 442 of the second horizontal wraparound leg 440.

Figure 28:
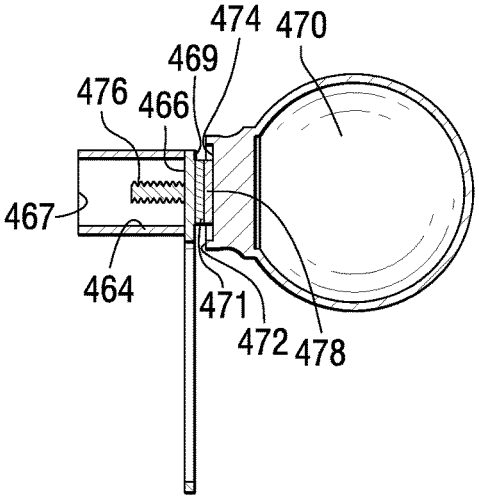
FIG. 28 is a partially schematic cross-sectional view of the alignment bracket assembly taken through line 28-28 of FIG. 25.
Figure 26:
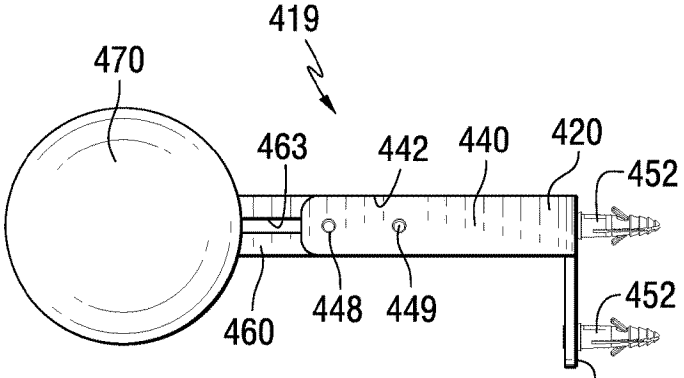
FIG. 26 is a side view of the alignment bracket assembly of FIG. 23.
Figure 27:
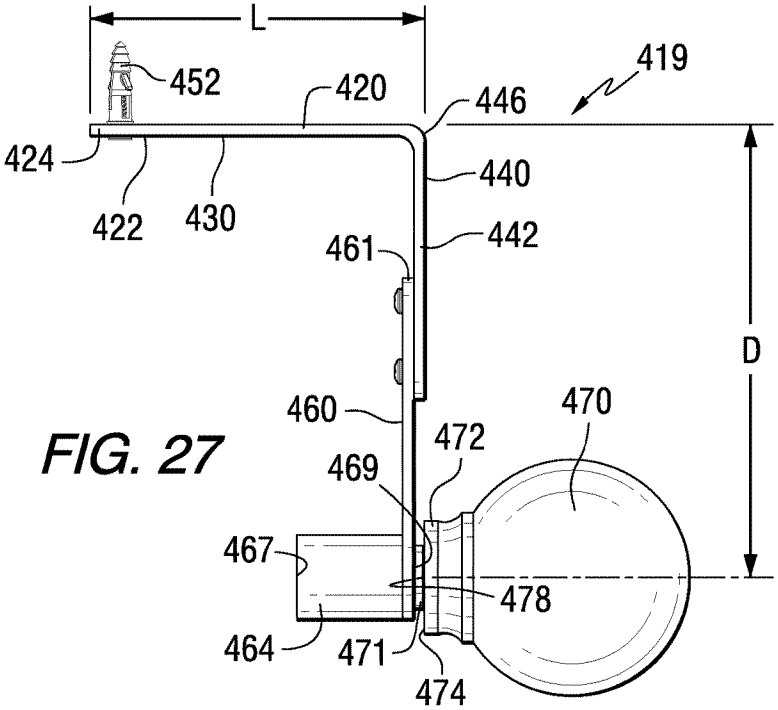
FIG. 27 is a top view of the alignment bracket assembly of FIG. 23.
Figure 25:
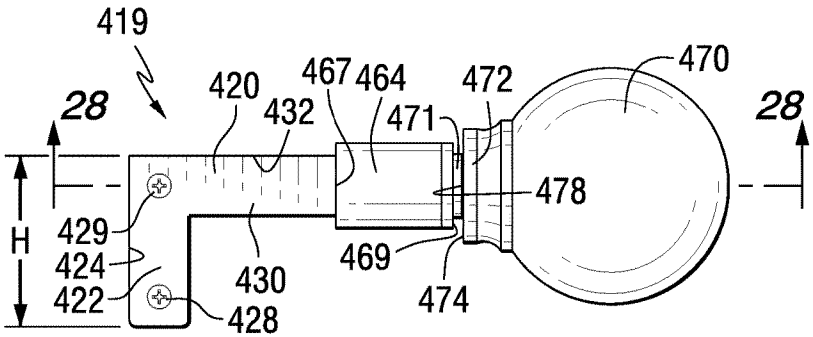
FIG. 25 is a front view of the alignment bracket assembly of FIG. 23.

As shown in FIGS. 22, 27 and 28, the bracket assembly 419 has a curtain overhang distance D, a curtain extension distance L, and a vertical height H selected to properly position the window curtain rod assembly 410 during installation around a window frame 402. Similar dimensions D, L and H may be used in the embodiment shown in FIGS. 20 and 21.

The curtain overhang distance D of the wraparound leg 440 of the bracket assembly 419 may be selected to position the telescoping rod 412 away from the wall and to provide a sufficient wraparound region 409 for the curtain 408. The curtain overhang distance D is measured along the length of the wraparound leg 440 and offsets the vertical guide leg 422 and first horizontal leg 430 from the axis of the telescoping curtain rod 412 in a direction perpendicular to the axis of the telescoping curtain rod. For example, the curtain overhang distance D may typically range from 0.5 to 8 inches, or from 1 to 6 inches, or from 1.5 to 4.5 inches. In accordance with an embodiment of the present invention, the curtain overhang distance D provides the wraparound region 409 as shown in FIG. 21 when a curtain is drawn onto the bracket assembly from the curtain rod 412. The curtain wraparound region 409 provides a light-blocking function in which the side edge of the curtain 408 overlaps or is adjacent to the exterior window frame sidewalls 404 and/or contacts or is adjacent to the wall in which the window is installed, which results in blocking light from entering a room.

The curtain extension distance L may be selected to allow the telescoping rod 412 and curtain to extend away from the exterior window frame sidewall 404 of the window frame 402 in a direction parallel with the axial direction of the telescoping curtain rod 412. The curtain extension distance L offsets the vertical guide edge 424 from the end 480 of the first rod section 414 and/or the rod abutment face 466 of the support arm 460 in a direction parallel with the axis of the telescoping curtain rod 412. For example, the curtain extension distance L of the bracket assembly 419 may typically be up to 8 inches, for example, from 1 to 6 inches, or from 3 to 5 inches. In certain embodiments, the curtain extension distance L may be minimized or eliminated, such that the edge of the curtain 408 in the wraparound region is located at or near the sidewall 404 of the window frame 402, e.g., if the first horizontal leg 430 is eliminated.

The vertical height H of the alignment mounting bracket 420 may be selected to properly position the window curtain rod assembly 410 during installation around a window frame 402. The vertical height H may be selected to provide the vertical guide edge 424 and to provide access to the alignment mounting bracket wall mounting holes 428 and 429. For example, the vertical height H may be up to 4 inches, for example, from 0.5 to 4 inches, or from 1 to 3 inches, or from 1.5 to 2.5 inches. In certain embodiments, the vertical height H may be reduced or eliminated, e.g., if the vertical leg 422 of the bracket assembly 419 is eliminated.

When the alignment mounting bracket 420 is positioned adjacent to the exterior window frame sidewall 404 or vertical portion of a window frame 402, the curtain extension distance L of the alignment mounting bracket 420 provides for the telescoping curtain rod 412 and the curtain to extend beyond the exterior window frame sidewall 404 or vertical portion of a window frame 402. This curtain extension distance L may be desirable to provide additional light-blocking and/or for aesthetics. The window curtain rod assembly 410 provides the light-blocking and aesthetic function, and provides the ability for the bracket assembly 419 to be mounted on the window stud without measuring.

As shown in FIGS. 22-27, a support arm 460 may be attached to the second horizontal leg 440 of the mounting bracket 420 of the bracket assembly 419, to thereby form an adjustable wraparound leg. The support arm 460 includes a first substantially cylindrical end 464 and a second end 461. The first substantially cylindrical end 464 defines an axis substantially aligned with an axial direction of the telescoping curtain rod 412. The second end 461 may be laterally offset from the first substantially cylindrical end 464 in a direction substantially perpendicular to the axis of the telescoping curtain rod 412 and/or the axis of the first substantially cylindrical end 464. The first substantially cylindrical end 464 may include a rod abutment face 466, a rod receiving opening 467 having an inner diameter selected based upon the outer diameter of the rod section that it receives, and a finial abutment face 469. In accordance with an embodiment of the present invention, a mounting section 462 may be provided between the first substantially cylindrical end 464 and the second end 461. The mounting section 462 of the support arm 460 may include a connection slot 463 configured to allow the alignment mounting bracket 420 to be slideably mounted on the second end 461 of the support.

As shown in FIG. 22, the rod abutment face 466 may include a threaded support arm stud or bolt 476 substantially aligned with the axis of the first substantially cylindrical end 464 and the axis of the telescoping rod 412. In the embodiment shown, the threaded support arm stud or bolt 476 is integrally formed with the rod abutment face. However, any other suitable arrangement may be used, e.g., the threaded support arm stud or bolt 476 may be threadingly engaged with the rod abutment face. As shown in FIG. 22, the end 480 of the first rod section 414 may include an internal sleeve 482 with a threaded hole 483. The threaded support arm stud or bolt 476 may be configured to be threadingly engaged with the threaded hole 483 of the sleeve 482. However, any other suitable shape and arrangement of engagement between the substantially cylindrical end 464 and the end 480 of first rod section 414 may be used, e.g., pins, mechanical fasteners, clamps, snap-fit, adhesives, or the like. In accordance with another embodiment of the present invention, rod abutment face 466 may not include a threaded support rod and the end 480 of the first rod section 414 may only be engaged by the first substantially cylindrical end 464. For example, the end 480 of first rod section 414 may be engaged by the first substantially cylindrical end 464 using frictional engagement, pins, mechanical fasteners, clamps, snap-fit, magnets, adhesives, or the like.

As shown in FIG. 22, the finial abutment face 469 includes a finial engagement magnet 471. In accordance with an embodiment of the present invention, the finial engagement magnet 471 may be located in the center of the finial abutment face 464. In the embodiment shown, the finial engagement magnet 471 is disk-shaped and is attached to the circular finial abutment face 469 using any suitable means, for example, adhesives, mechanical fasteners, clamps, snap-fit, or the like. Alternatively, the finial abutment face 469 may be formed of magnetic material. In accordance with another embodiment of the present invention, the finial abutment face 469 may comprise ferromagnetic materials, such as, iron, nickel, cobalt and the like, to attract the bracket engagement magnet 478 of the magnetic finial 470.

Figure 24:
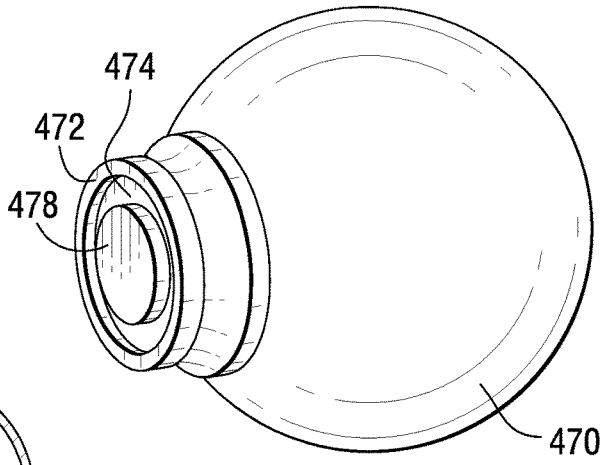
FIG. 24 is an isometric view of the removable finial of the alignment bracket assembly of FIG. 23.

As shown in FIGS. 23, 24 and 28, the magnetic finial 470 is removably attached to the bracket assembly 419. In accordance with an embodiment of the present invention, the finial includes an outer rim 472, a face 474 and a bracket engagement magnet 478. In the embodiment shown, the bracket engagement magnet 478 is attached to the face 474 by any suitable means. For example, adhesives, mechanical fasteners, clamps, snap-fit, or the like may be used to secure the bracket engagement magnet 478. Alternatively, the face 474 may be formed of magnetic material. In the embodiment shown, the bracket engagement magnet 478 comprises a circular disk shape, however, any other suitable shape of magnet may be used, e.g., rectangular, square, triangular, ovular, or the like. In the embodiment shown, the bracket engagement magnet 478 extends from the face 474 to a distance slightly beyond the outer rim 472. This results in the bracket engagement magnet 478 coming in close proximity to the finial engagement magnet 471 when a curtain is secured between the magnets 471 and 478 of the bracket assembly 419 and the removable finial 470. When the magnetic finial 470 is installed, its outer rim 472 contacts or comes in close proximity to the curtain 408 to thereby provide a desirable appearance.

In accordance with an embodiment of the present invention, the bracket engagement magnet 478 of the magnetic finial 470 allows the finial to be removed from the bracket assembly 419 for the curtain 408 to be drawn onto the wraparound leg 440 of the bracket assembly 419 to form the wraparound region 409. Once the curtain 408 is drawn onto the wraparound leg 440 of the bracket assembly 419, the magnetic finial 470 may be then be reattached to the bracket assembly 419 with the curtain 408 secured therebetween.

In accordance with an embodiment of the present invention, the magnetic connection between the finial 470 and the bracket assembly 419 allows the curtain 409 to be located therebetween without the necessity of cutting or tearing the fabric of the curtain 408. In the embodiment shown, the finial engagement magnet 471 and the bracket engagement magnet 478 may have a matching size and shape, and are oriented such that their poles attract each other. This results in the magnetic finial 470 being lined up with the axis of the telescoping curtain rod 412 when it is connected to bracket assembly 419.

The finial engagement magnet 471 and bracket engagement magnet 478 may be made of any suitable hard magnetic material known to those skilled in the art including ferromagnetic and rare earth materials.

As shown FIGS. 22-28, the alignment mounting bracket 420 may be secured to the wall with mechanical fasteners 450 and 451 through alignment mounting bracket wall mounting holes 428 and 429. In the embodiment shown, the mechanical fasteners 450 and 451 are threaded screws, however, any other suitable type of mechanical fasteners may be used, e.g., bolts or any other conventional type of mechanical fastener. In accordance with certain embodiments of the present invention, the mechanical fasteners may be self-tapping screws to secure the alignment mounting bracket 420 into metal and/or wood window studs. In accordance with certain embodiments, the mechanical fasteners may be secured using optional wall anchors 452. However, as described above, when the mounting bracket 420 is positioned adjacent to the window frame, a window stud is likely to be provided at such a location and the use of the wall anchors 452 may not be necessary. As shown in FIGS. 22, 23 and 25-27, the alignment mounting bracket 420 may be secured to the support arm 460 with mechanical fasteners 454 and 455 through the alignment mounting bracket 420 mounting holes 448 and 449, and the support arm 460 connection slot 463. In the embodiment shown, mechanical fasteners 450 is a threaded screw, however, any other suitable type of mechanical fastener may be used, e.g., a thumb screw, a bolt or any other conventional type of mechanical fastener.

FIG. 22 illustrates a second bracket assembly 519 of the window curtain rod assembly 410 in accordance with an embodiment of the present invention. Similar element numbers are used in FIG. 22 for common features that are present in the first bracket assembly 419 of FIGS. 20-28. As shown in FIG. 22, the bracket assembly 519 includes an alignment mounting bracket 520 and a support arm 560, and the second horizontal leg of the mounting bracket 520 in combination with the support arm 560 form an adjustable horizontal wraparound leg. The alignment mounting bracket 520 may be a mirror image of the alignment mounting bracket 420 as described in the first bracket assembly 419 as shown in FIGS. 20-28. The support arm 560 may be a mirror image of the support arm 460 as described in the first bracket assembly 419 as shown in FIGS. 21-28 with a first substantially cylindrical end 564 sized to receive the end 484 the second rod section 418. The alignment mounting bracket 520 and support arm 560 of the second bracket assembly 519 may be of the same or similar construction as the alignment mounting bracket 420 and support arm 460 as described in the first bracket assembly 419 as shown in FIGS. 20-28.

As shown in FIG. 22, the support arm 560 of the second bracket assembly 519 may be attached to the alignment mounting bracket 520 of the bracket assembly 519. The support arm 560 includes a first substantially cylindrical end 564 and a second end 561. The first substantially cylindrical end 564 defines an axis substantially aligned with an axial direction of the telescoping curtain rod 412. The second end 562 may be laterally offset from the first substantially cylindrical end 564 in a direction substantially perpendicular to the axis of the telescoping curtain rod 412 and/or the axis of the first substantially cylindrical end 564. The first substantially cylindrical end 564 may include a rod abutment face 566, a rod receiving opening 567 having an inner diameter selected based upon the outer diameter of the rod section that it receives, and a finial abutment face 569. In accordance with an embodiment of the present invention, a mounting section 562 may be provided between the first substantially cylindrical end 564 and the second end 561. The mounting section 562 of the support arm 560 may include a connection slot 563 configured to allow the alignment mounting bracket 520 to be slideably mounted on the second end 461 of the support. The support arm 560 of the second bracket assembly 519 may be of the same or similar construction as the support arm 460 as described in the first bracket assembly 419.

As shown in FIG. 22, the rod abutment face 566 may include a threaded support arm bolt or stud 576 substantially aligned with the axis of the first substantially cylindrical end 564 and the axis of the telescoping rod 412. As shown in FIG. 22, the end 484 of the second rod section 418 may include an internal sleeve 486 with a threaded hole 487. The threaded support arm bolt 576 may be configured to be threadingly engaged with the threaded hole 487 of the sleeve 486. However, any other suitable shape and arrangement of engagement between the substantially cylindrical end 564 and the end 488 of second rod section 418 may be used, e.g., pins, mechanical fasteners, clamps, snap-fit, adhesives, or the like. In accordance with another embodiment of the present invention, rod abutment face 566 may not include a threaded support rod and the end 484 of the second rod section 418 may only be engaged by the first substantially cylindrical end 564.

As shown in FIG. 22, the finial abutment face 569 may include a finial engagement magnet 571. In accordance with an embodiment of the present invention, the finial engagement magnet 571 may be located in the center of the finial abutment face 564. In the embodiment shown, the finial engagement magnet 571 is attached to the finial abutment face 569 using any suitable means. For example, adhesives, mechanical fasteners, clamps, snap-fit, or the like. Alternatively, the finial abutment face 569 may be formed of magnetic material.

As shown in FIG. 22, a finial 570 is removably attached to the bracket assembly 519. In accordance with an embodiment of the present invention, the finial includes an outer rim 572, face 574 and a bracket engagement magnet 578. The finial 570 of the second bracket assembly 519 may be of the same or similar construction as the finial 470 as described in the first bracket assembly 419.

The telescoping curtain rods, alignment mounting brackets, support arms, finials and fasteners may be made from any suitable materials such as plastics, metals and the like. For example, the telescoping curtain rods and the mounting alignment brackets may be made of metal such as aluminum and/or steel. The support arms and finials may be made of metals or polymeric materials such as polyethylene, polypropylene, nylon, and the like.

In accordance with an embodiment of the present invention, to install the window curtain rod assembly 410, the alignment mounting bracket 420 of the first bracket assembly 419 may be positioned along a first vertical portion of a window frame 402 and mounted, e.g., on an underlying window stud. The first magnetic finial 470 may be removed from the first bracket assembly 419. The alignment mounting bracket 520 of the second bracket assembly 519 may be positioned along an opposite vertical portion of a window frame 402 and mounted on an opposite window stud. The second magnetic finial 570 may be removed from the second bracket assembly 519. The curtain 408 may be installed on the first and/or second rod section 414 and 418. The end 480 of the first rod section 414 may be inserted into the first substantially cylindrical end 464 of the support arm 460 of the first bracket assembly 419. The threaded bolt 476 of the rod abutment face 466 may be engaged with the threaded hole 483 of the threaded sleeve 482 at the end 480 of the first rod section 414. The curtain 409 may be attached to the telescoping curtain rod 412. The end 484 of the second rod section 418 may be inserted into the first substantially cylindrical end 564 of the support arm 560 of the second bracket assembly 519. The first rod section 414 may then be axially locked with respect to the second rod section 418. The threaded bolt 576 of the of the rod abutment face 566 may be engaged with the threaded hole 487 of the threaded sleeve 486 at the end 484 of the second rod section 418. If not already done, the first magnetic finial 470 may be removed from the first bracket 419, and the curtain 408 may be drawn onto the wraparound leg 440 of the first bracket 419 into the wraparound region 409. The magnetic finial 470 may then be reattached to the first bracket 419 with a portion of the curtain 408 therebetween. If not already done, the second magnetic finial 570 may be removed from the second bracket 519, and the curtain 408 may be drawn onto the wraparound leg of the second bracket 519 into the second wraparound region on the opposite side of the curtain from the first wraparound region 409. The second magnetic finial 570 may then be reattached to the second bracket 519 with another portion of the curtain 408 therebetween.

Whereas particular embodiments of this invention have been described above for purposes of illustration, it will be evident to those skilled in the art that numerous variations of the details of the present invention may be made without departing from the invention as defined in the appended claims.

What is claimed is:

1. A window curtain rod assembly comprising:

a curtain rod comprising a first end and a second end;

a first bracket assembly structured and arranged to receive the first end of the curtain rod comprising a first wraparound leg extending perpendicularly away from a longitudinal axis of the curtain rod structured and arranged to receive a portion of a curtain, and a first removable magnetic finial structured and arranged to magnetically attach to the first bracket assembly with a portion of the curtain therebetween; and a second bracket assembly structured and arranged to receive the second end of the curtain rod comprising a second wraparound leg extending perpendicularly away from the longitudinal axis of the curtain rod structured and arranged to receive a portion of the curtain, and a second removable magnetic finial structured and arranged to magnetically attach to the second bracket assembly with a portion of the curtain therebetween.

2. The window curtain rod assembly of claim 1, wherein the first removable magnetic finial comprises a magnet alignable with a magnet attached to the first bracket assembly, and the second removable magnetic finial has a magnet alignable with a second magnet attached to the second bracket assembly.

3. The window curtain rod assembly of claim 1, wherein the first bracket assembly comprises a substantially cylindrical end structured and arranged to receive the first end of the curtain rod, and the second bracket assembly comprises a substantially cylindrical end structured and arranged to receive the second end of the curtain rod.

4. The window curtain rod assembly of claim 3, wherein the substantially cylindrical end of the first bracket assembly comprises a first finial abutment face, and the substantially cylindrical end of the second bracket assembly comprises a second finial abutment face.

5. The window curtain rod assembly of claim 4, wherein the finial abutment faces of the first and second bracket assembly comprise ferromagnetic materials.

6. The window curtain rod assembly of claim 4, wherein the first finial abutment face comprises a first finial engaging magnet, and the second finial abutment face comprises a second finial engaging magnet.

7. The window curtain rod assembly of claim 6, wherein the first and second finial engaging magnets are secured to the first and second finial abutment faces.

8. The window curtain rod assembly of claim 6, wherein the first and second finial engaging magnets are integrally formed with the first and second finial abutment faces.

9. The window curtain rod assembly of claim 6, wherein the first and second finial engaging magnets are generally disk-shaped, the first and second bracket engaging magnets are generally disk-shaped, and diameters of the first and second finial engaging magnets are substantially equal to diameters of the first and second bracket engaging magnets.

10. The window curtain rod assembly of claim 3, further comprising a first rod abutment face including a threaded bolt or stud extending into the substantially cylindrical end of the first bracket assembly and engageable with a threaded hole of the first end of the curtain rod, and a second rod abutment face including a threaded bolt or stud extending into the substantially cylindrical end of the second bracket assembly and engageable with a threaded hole of the second end of the curtain rod.

11. The window curtain rod assembly of claim 1, wherein the first and second wraparound legs have fixed lengths.

12. The window curtain rod assembly of claim 1, wherein the first and second wraparound legs have adjustable lengths.

13. The window curtain rod assembly of claim 1, wherein the first and second wraparound legs have overhang distances D of from 1 to 6 inches.

14. The window curtain rod assembly of claim 1, wherein the first and second ends of the curtain rod are axially moveable with respect to each other along the longitudinal axis of the curtain rod, and are lockable with respect to each other.

15. A method of mounting a window curtain rod assembly of claim 1 adjacent to a window, the method comprising:

fastening the first bracket assembly along a first vertical portion of a window frame;

fastening the second bracket assembly along a second vertical portion of the window frame;

installing the curtain onto the curtain rod;

inserting the first end of the curtain rod into the first bracket assembly;

inserting the second end of the curtain rod into the second bracket assembly;

drawing the curtain onto the first and second wraparound legs of the first and second bracket assemblies; and magnetically attaching the first and second removable magnetic finials to the first and second bracket assemblies.

16. A bracket assembly for a window curtain rod comprising:

a bracket including a first substantially cylindrical end defining an axial direction structured and arranged to receive an end of a curtain rod, and a wraparound leg laterally offset from the first substantially cylindrical end in a direction substantially perpendicular to the axial direction of the first substantially cylindrical end structured and arranged to receive a portion of a curtain; and a magnetic finial removably magnetically attached to the bracket structured and arranged to magnetically attach to the bracket with a portion of the curtain therebetween.

17. A window curtain and rod assembly comprising:

a curtain rod comprising a first end and a second end;

a first bracket assembly structured and arranged to receive the first end of the curtain rod comprising a first wraparound leg extending perpendicularly away from a longitudinal axis of the curtain rod;

a second bracket assembly structured and arranged to receive the second end of the curtain rod comprising a second wraparound leg extending perpendicularly away from the longitudinal axis of the curtain rod; and a curtain mounted on the curtain rod, wherein the curtain is drawn onto the first and second wraparound legs to thereby provide first and second curtain wraparound regions;

a first magnetic finial magnetically attached to the first bracket assembly with a portion of the curtain therebetween; and a second magnetically finial magnetically attached to the second bracket assembly with another portion of the curtain therebetween.

* * * * *